US011165208B2

(12) United States Patent
Lim et al.

(10) Patent No.: US 11,165,208 B2
(45) Date of Patent: Nov. 2, 2021

(54) ELECTRICAL CONTACT AND CONNECTOR

(71) Applicant: 3M INNOVATIVE PROPERTIES COMPANY, St. Paul, MN (US)

(72) Inventors: Chin Hua Lim, Singapore (SG); Saujit Bandhu, Singapore (SG); Alexander W. Barr, Austin, TX (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 0 days.

(21) Appl. No.: 14/345,296

(22) PCT Filed: Sep. 24, 2012

(86) PCT No.: PCT/US2012/056803
§ 371 (c)(1),
(2) Date: Mar. 17, 2014

(87) PCT Pub. No.: WO2013/048918
PCT Pub. Date: Apr. 4, 2013

(65) Prior Publication Data

US 2014/0335727 A1 Nov. 13, 2014

Related U.S. Application Data

(60) Provisional application No. 61/540,253, filed on Sep. 28, 2011.

(51) Int. Cl.
*H01R 13/648* (2006.01)
*H01R 31/00* (2006.01)
(Continued)

(52) U.S. Cl.
CPC ..... *H01R 31/00* (2013.01); *H01R 12/71* (2013.01); *H01R 12/724* (2013.01); *H01R 13/658* (2013.01)

(58) Field of Classification Search
CPC ..... H01R 13/65802; H01R 13/658; H01R 13/506; H01R 23/6873; H01R 23/7073
(Continued)

(56) References Cited

U.S. PATENT DOCUMENTS 5,281,169 A * 1/1994 Kiat ..... H01R 12/712 439/607.35
6,004,169 A * 12/1999 Wu ..... H01R 13/11 439/567
(Continued)

FOREIGN PATENT DOCUMENTS

JP 2009-009729 1/2009

OTHER PUBLICATIONS

PCT International Search Report from PCT/US2012/056803 dated Feb. 28, 2013, 3 pages.

*Primary Examiner* — Abdullah A Riyami
*Assistant Examiner* — Vladimir Imas
(74) *Attorney, Agent, or Firm* — Michael Stern

(57) ABSTRACT

An electrical contact includes a longitudinal first body portion, a longitudinal second body portion, a terminal portion, and a contact portion. The longitudinal first body portion has a terminal end, a first transition end opposite the terminal end, and a major surface generally lying in a first plane. The longitudinal second body portion has a contact end, a second transition end opposite the contact end, and a major surface generally lying in a second plane intersecting the first plane. The contact end is distal to the first transition end. The terminal portion extends from the first body portion at the terminal end. The contact portion extends from the second body portion at the contact end.

11 Claims, 17 Drawing Sheets

(51) Int. Cl.
*H01R 12/72* (2011.01)
*H01R 12/71* (2011.01)
*H01R 13/658* (2011.01)

(58) Field of Classification Search
USPC ..... 439/607.01, 660
See application file for complete search history.

(56) References Cited

U.S. PATENT DOCUMENTS 6,027,375 A * 2/2000 Wu ..... H01R 13/502 439/607.02
6,224,422 B1 * 5/2001 Zhu ..... H01R 23/6873 439/607.01
6,319,061 B1 * 11/2001 Chen ..... H01R 13/6582 439/607.15
7,445,505 B1 * 11/2008 Yi ..... H01R 13/6485 439/181
7,481,677 B1 * 1/2009 Yi ..... H01R 13/6485 439/541.5
7,517,249 B1 * 4/2009 Zhang ..... H01R 12/7029 439/607.01
7,527,528 B2 * 5/2009 Yu ..... G06K 7/0034 439/489
7,549,896 B2 * 6/2009 Zhang ..... H01R 12/707 439/607.01
7,604,512 B1 * 10/2009 Chen ..... H01R 13/5045 439/660
7,695,318 B1 * 4/2010 Wang ..... H01R 13/65802 439/607.01
7,753,729 B2 * 7/2010 Wang ..... H01R 13/41 439/607.01
7,806,735 B1 * 10/2010 Chen ..... H01R 13/65802 439/676
7,850,465 B1 * 12/2010 Wan ..... H01R 13/658 439/79
7,862,346 B1 * 1/2011 Wan ..... H01R 12/712 439/79
7,959,478 B2 * 6/2011 Chiu ..... H01R 13/65802 439/885
7,972,182 B2 * 7/2011 Zheng ..... H01R 13/658 439/660
8,021,195 B2 * 9/2011 He ..... H01R 13/502 439/638
8,038,474 B2 * 10/2011 Ju ..... H01R 27/00 439/607.01
8,231,410 B2 * 7/2012 Tung ..... H01R 13/514 439/607.01
8,303,329 B2 * 11/2012 Wu ..... H01R 12/675 439/395
8,323,057 B2 * 12/2012 Ho ..... H01R 12/725 439/607.4
8,333,614 B2 * 12/2012 Xiong ..... H01R 12/716 439/660
2005/0118876 A1 6/2005 Niitsu et al.
2007/0207674 A1 9/2007 Minich
2007/0207675 A1 9/2007 Minich
2009/0017646 A1 1/2009 Nagata et al.
2010/0159749 A1 6/2010 Ohkuma
2011/0097933 A1 4/2011 Sommers et al.

* cited by examiner

ELECTRICAL CONTACT AND CONNECTOR

TECHNICAL FIELD

The present disclosure relates to electrical contacts used in electrical connectors. In particular, the present invention relates to electrical contacts configured to facilitate high speed signal transmissions in high speed electrical connectors.

BACKGROUND

High speed data transfer systems require electrical connectors in which the electrical impedance can be controlled in order to maintain the required data transfer rate of the system. It is desirable at high speed data rates to obtain a specific impedance in an electrical connector that matches the impedance of the entire system. The impedance may be controlled by the spacing of the electrical contacts, the size of the electrical contacts, and the thickness and location of material within the connector housing, for example.

As user requirements grow more demanding with respect to both electrical connector sizes and data transfer rates, the design and manufacture of electrical connectors that can perform satisfactorily in terms of both physical size and electrical performance has grown more difficult. For example, in SFP (Small Form Factor Pluggable) and SFP-like applications, small electrical connectors are desired in electronic devices in which space is a premium. In these electrical connectors, it is difficult to control the impedance by the spacing and size of the electrical contacts in a reduced-size connector housing while also maintaining the mechanical functions of the electrical connector, such as, for example, electrical contact retention and engagement.

SUMMARY

In one aspect, the present invention provides an electrical contact including a longitudinal first body portion, a longitudinal second body portion, a terminal portion, and a contact portion. The longitudinal first body portion has a terminal end, a first transition end opposite the terminal end, and a major surface generally lying in a first plane. The longitudinal second body portion has a contact end, a second transition end opposite the contact end, and a major surface generally lying in a second plane intersecting the first plane. The contact end is distal to the first transition end. The terminal portion extends from the first body portion at the terminal end. The contact portion extends from the second body portion at the contact end.

In another aspect, the present invention provides an electrical connector including an insulative body, a tongue, and sets of electrical contacts. The insulative body has a front face. The tongue extends from the front face in a direction away from the insulative body. The tongue has a top tongue surface and a bottom tongue surface. One set of electrical contacts is disposed in one set of tongue slots incorporated at the top tongue surface of the tongue and another set of electrical contacts is disposed in another set of tongue slots incorporated at the bottom tongue surface of the tongue. The tongue slots incorporated at the bottom tongue surface are aligned to the tongue slots incorporated at the top tongue surface. Each electrical contact includes a longitudinal first body portion, a longitudinal second body portion, a terminal portion, and a contact portion. The longitudinal first body portion has a terminal end, a first transition end opposite the terminal end, and a major surface generally lying in a first plane. The longitudinal second body portion has a contact end, a second transition end opposite the contact end, and a major surface generally lying in a second plane intersecting the first plane. The contact end is distal to the first transition end. The terminal portion extends from the first body portion at the terminal end. The contact portion extends from the second body portion at the contact end.

In another aspect, the present invention provides an electrical contact including a longitudinal first body portion configured for broadside coupling, and a longitudinal second body portion configured for edge coupling and extending from the longitudinal first body portion, such that an $S_{21}$ of the electrical contact is less than about 2 dB for frequencies less than about 10 GHz.

In another aspect, the present invention provides an electrical contact including a longitudinal first body portion configured for broadside coupling, and a longitudinal second body portion configured for edge coupling and extending from the longitudinal first body portion, such that an impedance of the electrical contact is between about 40Ω and about 60Ω for a single ended application, and between about 80Ω and about 120Ω for a differential application.

In another aspect, the present invention provides an electrical contact including a longitudinal first body portion configured for broadside coupling, and a longitudinal second body portion configured for edge coupling and extending from the longitudinal first body portion, such that a crosstalk of the electrical contact is less than about −30 dB for frequencies up to about 20 GHz.

In another aspect, the present invention provides an electrical connector including an insulative body and at least one electrical contact disposed in the insulative body. The at least one electrical contact includes a longitudinal first body portion configured for broadside coupling and a longitudinal second body portion configured for edge coupling and extending from the first body portion. The second body portion remains in a fixed position when engaged with a mating electrical contact.

In another aspect, the present invention provides an electrical contact including a longitudinal first body portion configured for broadside coupling, and a longitudinal second body portion configured for edge coupling and extending transversely from the first body portion.

In another aspect, the present invention provides an electrical contact including a longitudinal first body portion configured for broadside coupling, and a longitudinal second body portion configured for edge coupling and extending from the first body portion, such that the first body portion is within a projected width of the second body portion when viewed from a top of the electrical contact.

The above summary of the present invention is not intended to describe each disclosed embodiment or every implementation of the present invention. The Figures and detailed description that follow below more particularly exemplify illustrative embodiments.

DETAILED DESCRIPTION

In the following detailed description of the preferred embodiments, reference is made to the accompanying drawings that form a part hereof. The accompanying drawings show, by way of illustration, specific embodiments in which the invention may be practiced. It is to be understood that other embodiments may be utilized, and structural or logical changes may be made without departing from the scope of the present invention. The following detailed description, therefore, is not to be taken in a limiting sense, and the scope of the invention is defined by the appended claims.

There are many ways to accommodate the increase in demand for high speed data storage capacity within an electronic device including increasing the storage capacity of the data storage device or increasing the number of data storage devices in the electronic device or increasing both the storage capacity and the number of data storage devices in the electronic device.

Currently, a small form factor connector is able to connect only up to four data storage devices. This is because the number of contacts (also referred to as terminals) within the connector is limited, conventionally to about 26 of them. If there is a need to have more data storage devices in the electronic device, additional connectors would have to be installed or the width of the connector would have to be increased to accommodate more contacts in the connector resulting in taking up more real estate on the printed circuit board (PCB). For some small electronic devices, it may not be possible to allocate more real estate (which is limited) on the PCB for the installation of additional connectors.

As the size of the connector is small, the contacts are naturally very fine, in some instances having a width of about 0.2 mm to about 0.4 mm. Reducing the width of the contacts to accommodate more contacts within the same physical size of the connector may result in signal loss due to poor mating of the contacts in the connector on the data storage device and the contacts in the connector on the PCB. In addition, due to the closeness of one contact to another contact in a small form factor connector, the likelihood of crosstalk error between contacts increases as the speed of the data exchange increases.

It would be desirable to have an electrical connector system that can interconnect more data storage devices without substantially increasing the connector footprint on the PCB. It would also be desirable to have an electrical connector system that can interconnect high speed data storage devices with minimum crosstalk errors.

Figure 1:
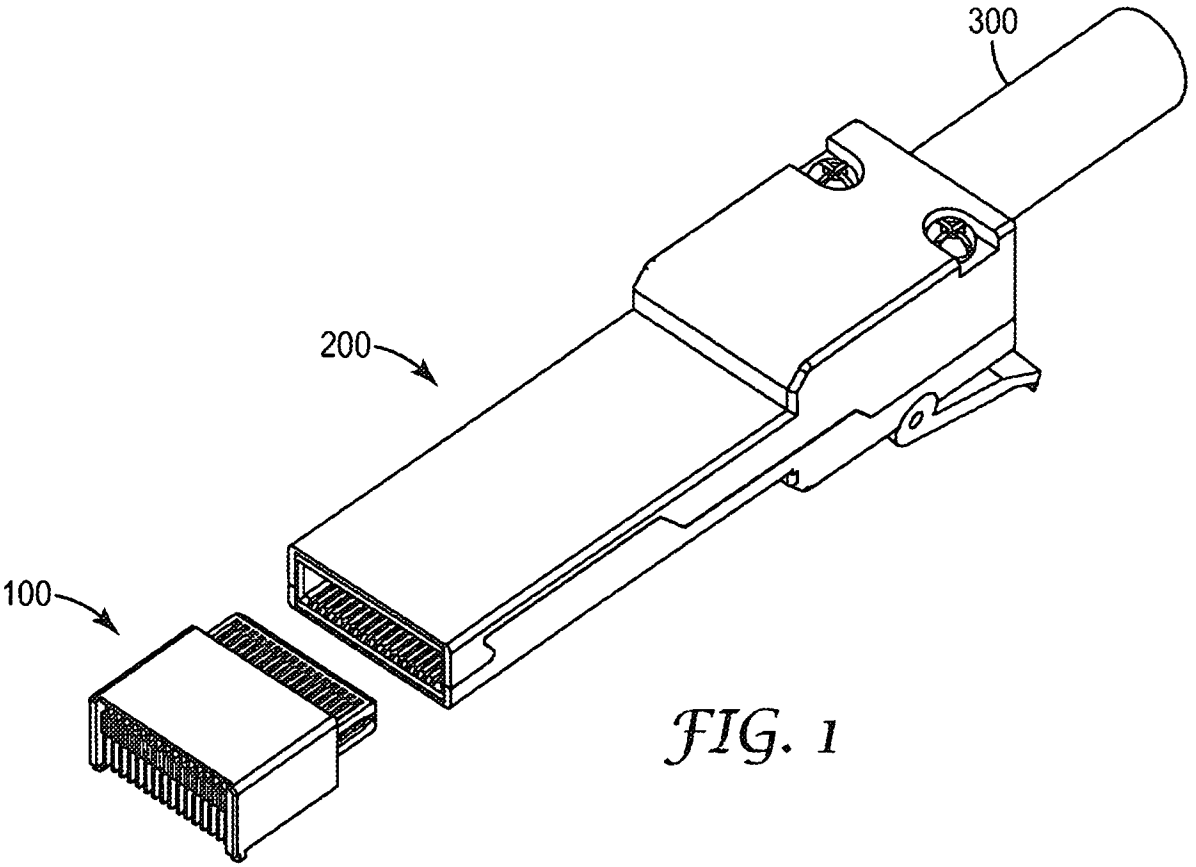
FIG. 1 is a top perspective view of an exemplary embodiment of an electrical connector system according to an aspect of the present invention including an electrical connector and a mating connector assembly positioned for mating with the electrical connector.

Referring now to the Figures, FIG. 1 illustrates an exemplary embodiment of an electrical connector system according to an aspect of the present invention including an electrical connector 100 and a mating connector assembly 200 positioned for mating with electrical connector 100. In some embodiments, electrical connector 100 is configured for mounting on a PCB (not illustrated), and mating connector assembly 200 is configured for coupling to a shielded cable 300.

Figure 2:
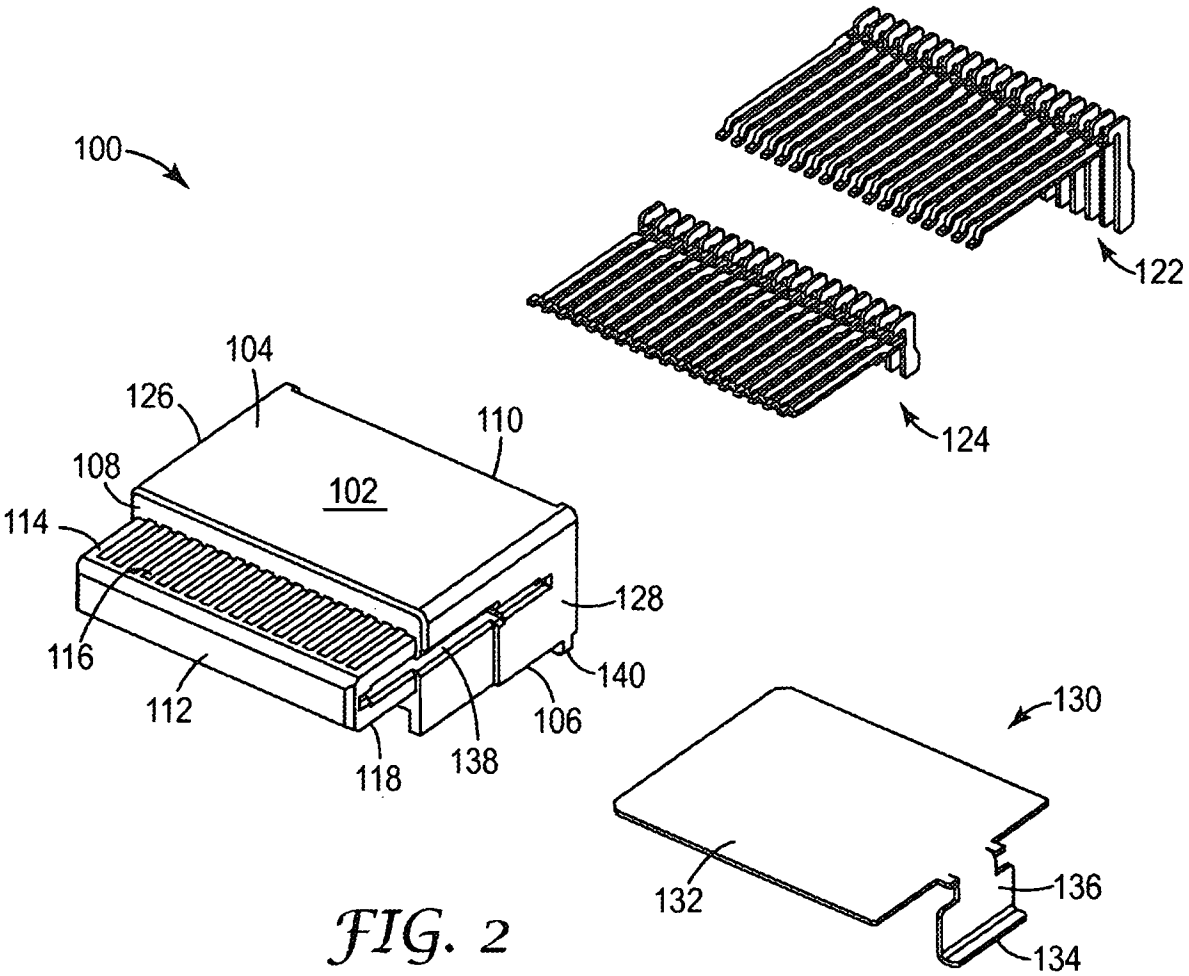
FIG. 2 is an exploded top perspective view of the electrical connector of FIG. 1.
Figure 3:
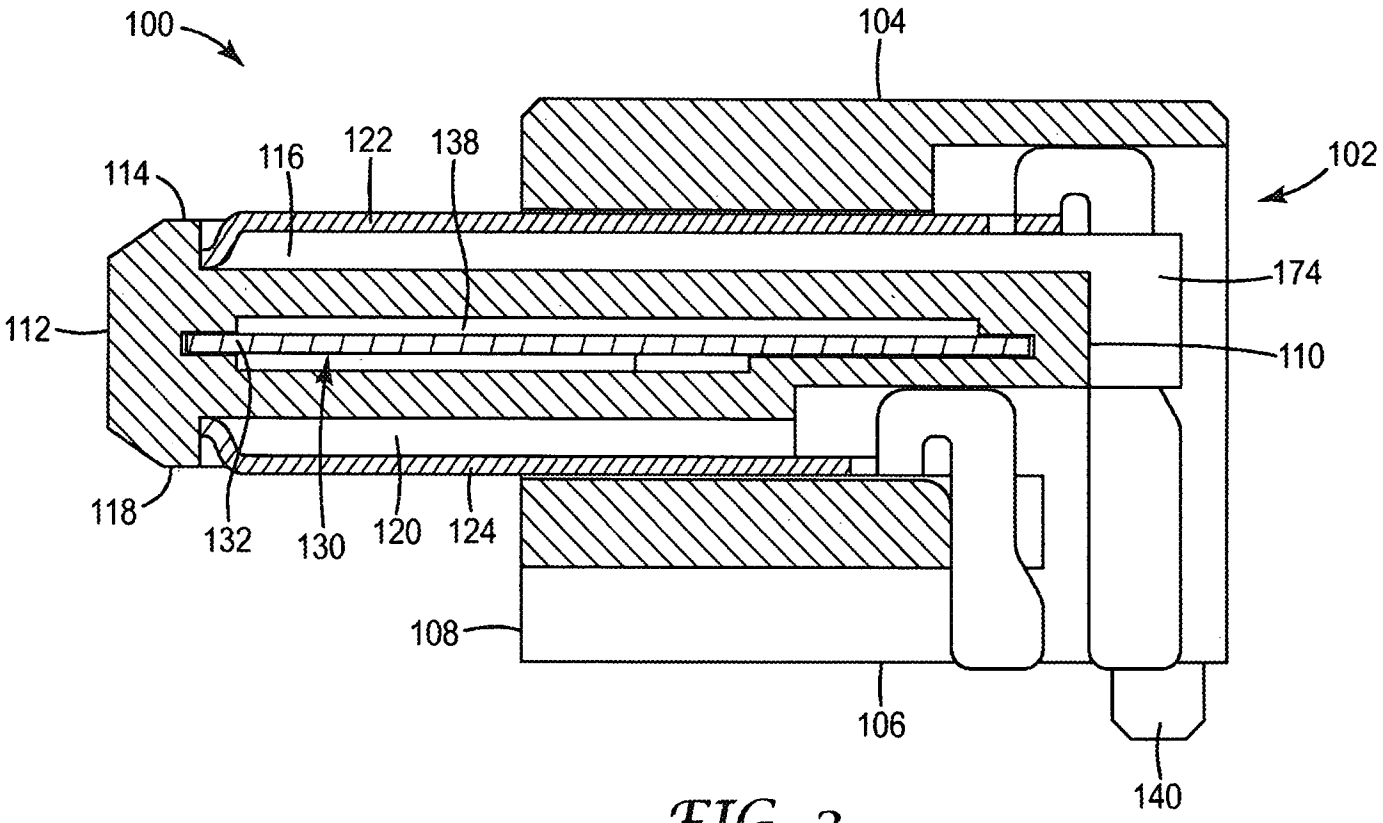
FIG. 3 is a side cross-sectional view of the electrical connector of FIG. 1.

With reference to FIGS. 2 and 3, an exemplary embodiment of an electrical connector 100 according to an aspect of the present invention includes an insulative body 102, in some embodiments formed from a dielectric material, having a top 104, a bottom 106, a front face 108 and a rear face 110. Extending from front face 108 away from insulative body 102 is a tongue 112 having a top tongue surface 114 with a first set of tongue slots 116 which extends from tongue 112 into insulative body 102 and a bottom tongue surface 118 with a second set of tongue slots 120 (illustrated in FIG. 3) aligned to first set of tongue slots 116 and extending from tongue 112 into insulative body 102. Mounted in first set of tongue slots 116 is a first set of electrical contacts 122 and mounted in second set of tongue slots 120 is a second set of electrical contacts 124.

Electrical connector 100 further includes a first body side 126, a second body side 128 and a lateral slot extending from one body side of the connector, wherein the lateral slot is configured to receive a ground member. In some embodiments, the ground member includes a lateral portion which is inserted into the lateral slot in electrical connector 100, a tail portion for bonding electrical connector 100 to a PCB and a body portion connecting the lateral portion to the tail portion. Electrical connector 100 may further be held onto a PCB by terminal portions of the electrical contacts, which may provide a surface-mount connection or a though-hole connection.

In the embodiment illustrated in FIGS. 2 and 3, a ground member 130 includes a lateral portion 132, a tail portion 134, and a body portion 136 connecting lateral portion 132 to tail portion 134. Lateral portion 132 is inserted in a lateral slot 138 which extends in electrical connector 100 from first body side 126 to second body side 128 between first set of tongue slots 116 and second set of tongue slots 120. Tail portion 134 when bonded to a PCB secures electrical connector 100 to the PCB. Different ways of bonding tail portion 134 to a PCB may be used, such as, for example, soldering. Lateral portion 132 of ground member 130 extends from first body side 126 to second body side 128. In addition to an attachment device for bonding electrical connector 100 to a PCB, ground member 130 acts as a grounding device and shields first set of electrical contacts 122 from second set of electrical contacts 124 (and vice versa) thereby reducing crosstalk between the two sets of terminals, which advantageously enables high speed connection.

In some embodiments, electrical connector 100 further includes a plurality of mounting posts 140 extending from bottom 106 of insulative body 102, which facilitate the mounting of electrical connector 100 to a PCB.

While a header connector is used to explain and illustrate electrical connector 100, it is possible to replace the header connector with a socket connector and/or use a hybrid connector that functions both as a socket connector and a header connector, without changing the spirit of the invention.

When designing an electrical connector, one goal is to minimize the changes in impedance as the signal travels through the electrical connector. By minimizing the changes in impedance, distortion and attenuation of the signal are reduced, thereby improving the electrical connector's performance, allowing it to perform at high data transmission rates, such as, for example 12 Gbps (billions of bits per second). In one aspect, the present invention relates to an electrical contact that minimizes the changes in impedance. This electrical contact includes a first body portion having a major surface generally lying in a first plane and a second body portion having a major surface generally lying in a second plane intersecting the first plane. In some embodiments, the electrical contact includes a portion configured to facilitate broadside coupling of the electrical contact, and a portion configured to facilitate edge coupling of the electrical contact.

Figure 4:
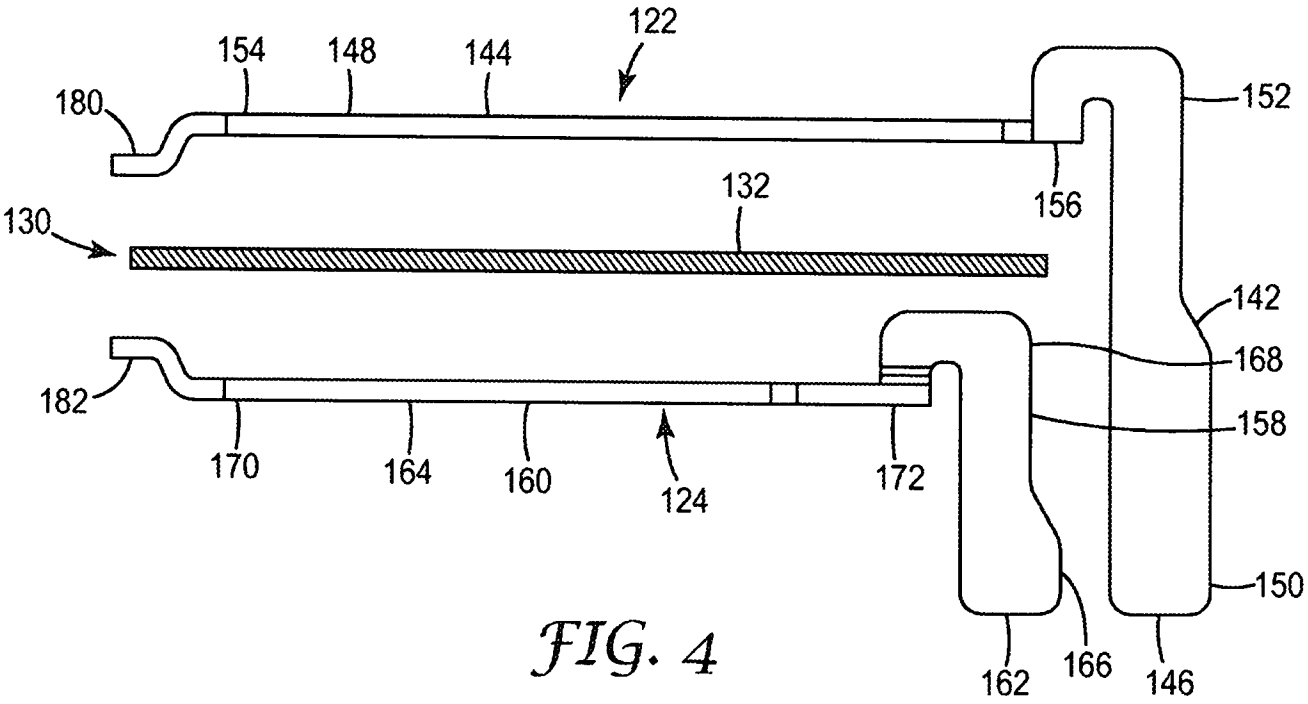
FIG. 4 is a side view of the electrical contacts and ground member of the electrical connector of FIG. 1.

FIG. 4 is a side view illustrating first set of electrical contacts 122, second set of electrical contacts 124, and ground member 130 of electrical connector 100. Each electrical contact of first set of electrical contacts 122 includes a longitudinal first body portion 142, a longitudinal second body portion 144, a terminal portion 146, and a contact portion 148. First body portion 142 includes a terminal end 150, a first transition end 152 opposite terminal end 150, and a major surface generally lying in a first plane. Second body portion 144 includes a contact end 154, a second transition end 156 opposite contact end 154, and a major surface generally lying in a second plane intersecting the first plane. Contact end 154 is distal to first transition end 152. Terminal portion 146 extends from first body portion 142 at terminal end 150. Contact portion 148 extends from second body portion 144 at contact end 154. Each electrical contact of second set of electrical contacts 124 includes a longitudinal first body portion 158, a longitudinal second body portion 160, a terminal portion 162, and a contact portion 164. First body portion 158 includes a terminal end 166, a first transition end 168 opposite terminal end 166, and a major surface generally lying in a first plane. Second body portion 160 includes a contact end 170, a second transition end 172 opposite contact end 170, and a major surface generally lying in a second plane intersecting the first plane. Contact end 170 is distal to first transition end 168. Terminal portion 162 extends from first body portion 158 at terminal end 166. Contact portion 164 extends from second body portion 160 at contact end 170.

In some embodiments, electrical connector 100 includes an insulative body 102, and at least one electrical contact disposed in insulative body 102. For example, electrical connector 100 includes a first set of electrical contacts 122 and a second set of electrical contacts 124 disposed in insulative body 102. Each electrical contact of first set of electrical contacts 122 includes a longitudinal first body portion 142 configured for broadside coupling and a longitudinal second body portion 144 configured for edge coupling and extending from first body portion 142. Each electrical contact of second set of electrical contacts 124 includes a longitudinal first body portion 158 configured for broadside coupling and a longitudinal second body portion 160 configured for edge coupling and extending from first body portion 158. In some embodiments, second body portions 144, 160 remain in a fixed position when engaged with a mating electrical contact, such as, e.g., an electrical contact of mating connector 206. To accommodate this, referring to FIGS. 2 and 3, the electrical contact of first set of electrical contacts 122 may include a support portion 180 that extends from contact portion 148 at contact end 154 and supports second body portion 144 in first set of tongue slots 116 of insulative body 102, and each electrical contact of second set of electrical contacts 124 may include a support portion 182 that extends from contact portion 164 at contact end 170 and supports second body portion 160 in second set of tongue slots 120 of insulative body 102, as illustrated in FIG. 3. Support portions 180, 182 are configured to hold contact portions 148, 164 in a fixed position at contact ends 154, 170, respectively, with respect to insulative body 102. Support portions 180, 182 may have a reduced width relative to contact portions 148,164 (as illustrated in FIG. 3), a chamfer, or any other suitable configuration to facilitate assembly of the electrical contacts in insulative body 102. To accommodate an effective mechanical and electrical connection between contact portions 148, 164 and mating electrical contacts, such as, e.g., electrical contacts of mating connector 206, second body portions 144, 160 may be resilient. In some embodiments, using an electrical contact of the first set of electrical contacts 122 as an example, a width $W_{B2}$ (illustrated in FIG. 5) of second body portion 144 is greater than a thickness $T_{B2}$ (illustrated in FIG. 5) of second body portion 144.

While the features of an electrical contact from the first set of electrical contacts 122 are similar to the features of an electrical contact from the second set of electrical contacts 124, the configuration and physical dimensions of these features of each electrical contact from the first set of electrical contacts 122 may be different than those of each electrical contact from the second set of electrical contacts 124. For example, as illustrated in FIG. 2, each second body portion 144 is positioned on one side (to the right as viewed from rear face 110) of first body portion 142, while each second body portion 160 is positioned on the opposite side (to the left as viewed from rear face 110) of first body portion 158. This is because every electrical contact in first set of electrical contacts 122 is aligned to a corresponding electrical contact in second set of electrical contacts 124. With this electrical contact arrangement, the physical width of electrical connector 100 as well as the footprint which electrical connector 100 occupies on a PCB may be kept small. To accommodate the proper alignment of first set of electrical contacts 122 with respect to first set of tongue slots 116 and second set of electrical contacts 124 with respect to second set of tongue slots 120 while positioning terminal portion 146 and terminal portion 162 for mounting to a PCB, first body portion 142 may have a greater length than first body portion 158. Referring to FIG. 3, by adding a rear face extension 174 to rear face 110, first set of electrical contacts 122 may be mounted in first set of tongue slots 116 and aligned behind second set of electrical contacts 124 while maintaining a safe distance from second set of electrical contacts 124. To accommodate this arrangement, second body portion 144 may have a greater length than second body portion 160.

In some embodiments, the geometry and relative position of first set of electrical contacts 122, second set of electrical contacts, ground member 130, and insulative body 102 may be selected to provide a characteristic impedance of electrical connector 100 of a desired target value, such as, e.g., 50Ω for single ended applications or 100Ω for differential applications.

Contact portions 148, 164 serve to connect electrical connector 100 electrically to a complementary connector, such as, e.g., mating connector 206 of mating connector assembly 200, via contacts in the complementary connector, while terminal portions 146, 162 are mounted to a PCB so as to connect the electrical contacts of electrical connector 100 to corresponding conductive pads formed on the PCB. In some embodiments, terminal portions 146, 162 are configured to provide a surface-mount connection to a PCB. In some embodiments, terminal portions 146, 162 are configured to provide a through-hole connection to a PCB. This through-hole connection may be a solder connection, whereby terminal portions 146, 162 are inserted and soldered in corresponding vias in the PCB, or a press-fit connection, whereby terminal portions 146, 162 are inserted and press-fitted in corresponding vias in the PCB. Electrical connection of terminal portions 146, 162 to a PCB may be achieved using any suitable method/structure, including but not limited to press-fit, soldering, surface mount, friction fit, mechanical clamping, and adhesive.

The robustness of a connector may depend on, amongst other parameters, the width of the contact portions of the electrical contacts in the connector which determines the area of contact between two mating connectors. In small form factor connectors, the width of the contact portion of an electrical contact in a connector is often in the range of about 0.2 mm to about 0.4 mm. As the width is decreased, the area of contact between two connectors decreases and therefore, the robustness of the connector decreases. Having a relatively wide contact portion and keeping the width of the terminal portion to be the same as the contact portion will mean that the footprint of the connector on a PCB needs to be increased. The ability to increase the footprint of a connector may not be possible if the real estate on the PCB is limited as in a compact electronic device.

By providing electrical contacts where the first body portion has a major surface generally lying in a first plane and the second body portion has a major surface generally lying in a second plane intersecting the first plane, the robustness of the connector may be maintained by having a relatively wide contact portion without increasing the footprint of the connector on a PCB. In some embodiments, a small form factor connector has a width $W_C$ (illustrated in FIG. 5) of contact portions 148, 164 set to about 0.4 mm while width $W_T$ (illustrated in FIG. 5) of terminal portions 146, 162 is set to about 0.2 mm to provide good electrical contact between two connectors and maintaining a pitch of about 0.8 mm between adjacent contacts as required in most small form factor connectors.

In one aspect, as illustrated in FIGS. 3 and 4, electrical connector 100 is configured such that second body portion 144 and contact portion 148 of first set of electrical contacts 122 and second body portion 160 and contact portion 164 of second set of electrical contacts 124 are held in a predetermined fixed relative position with respect to lateral portion 132 of ground member 130. The controlled predetermined distance of second body portion 144 and contact portion 148 of first set of electrical contacts 122 and second body portion 160 and contact portion 164 of second set of electrical contacts 124 from lateral portion 132 of ground member 130 helps optimize the reflection of the signals, which minimizes the impedance mismatch and the possibility of data loss associated therewith, in particular in applications that require high data rate transmission. Also, the presence of lateral portion 132 of ground member 130 reduces crosstalk between first set of electrical contacts 122 and second set of electrical contacts 124, which improves the electrical performance of electrical connector 100. In one aspect, to minimize crosstalk between first set of electrical contacts 122 and second set of electrical contacts 124, it is beneficial for second body portion 144 of first set of electrical contacts 122 and second body portion 160 of second set of electrical contacts 124 to extend substantially along a width of lateral portion 132 of ground member 130, as illustrated in FIG. 4.

In one application, an electrical contact of a set of electrical contacts may be coupled to an adjacent electrical contact of the same set. To facilitate this application, using first set of electrical contacts 122 as an example, first body portion 142 has a major surface generally lying in a first plane, and may be configured to facilitate broadside coupling between adjacent electrical contacts. To facilitate broadside coupling, first body portion 142 of the electrical contact is held in a predetermined fixed relative position with respect to first body portion 142 of the adjacent electrical contact by terminal portion 146 (when connected to a PCB) and rear face extension 174 of insulative body 102. The controlled predetermined distance of first body portion 142 of the electrical contact and first body portion 142 of the adjacent electrical contact helps optimize the reflection of the signals, which minimizes the impedance mismatch and the possibility of data loss associated therewith, in particular in applications that require high data rate transmission. Second body portion 144 has a major surface generally lying in a second plane intersecting the first plane, and may be configured to facilitate edge coupling between adjacent electrical contacts. To facilitate edge coupling, second body portion 144 of the electrical contact is held in a predetermined fixed relative position with respect to second body portion 144 of the adjacent electrical contact by first set of tongue slots 116.

Compared to electrical contacts that are configured to facilitate only broadside coupling or only edge coupling, electrical contacts according to aspects of the present invention that include a first body portion having a major surface generally lying in a first plane, wherein the first body portion may be configured to facilitate broadside coupling, and a second body portion having a major surface generally lying in a second plane intersecting the first plane, wherein the second body portion may be configured to facilitate edge coupling, provide a significant improvement in electrical performance.

Figure 5:
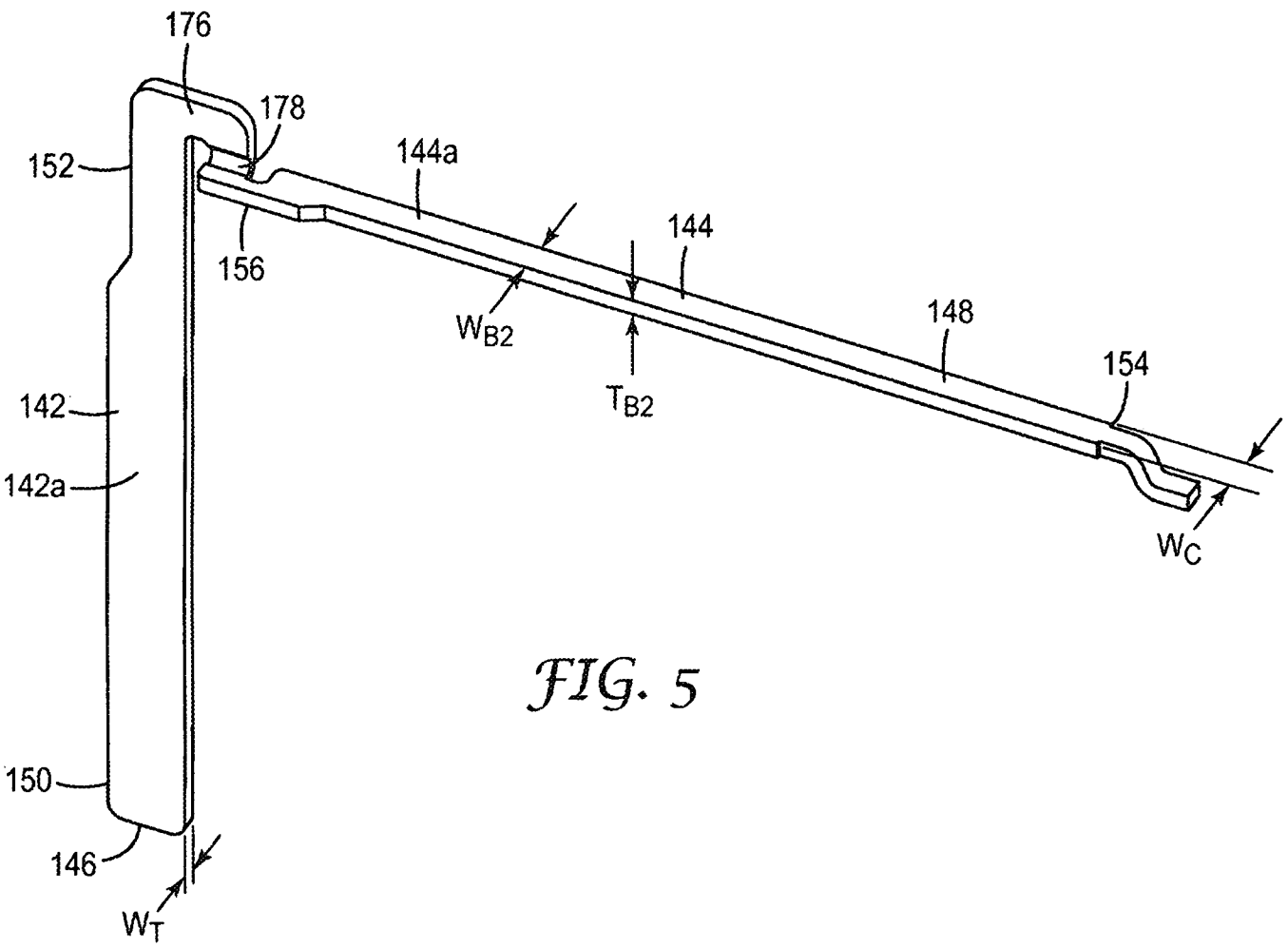
FIG. 5 is a top perspective view of an exemplary embodiment of an electrical contact according to an aspect of the present invention.
Figure 6:
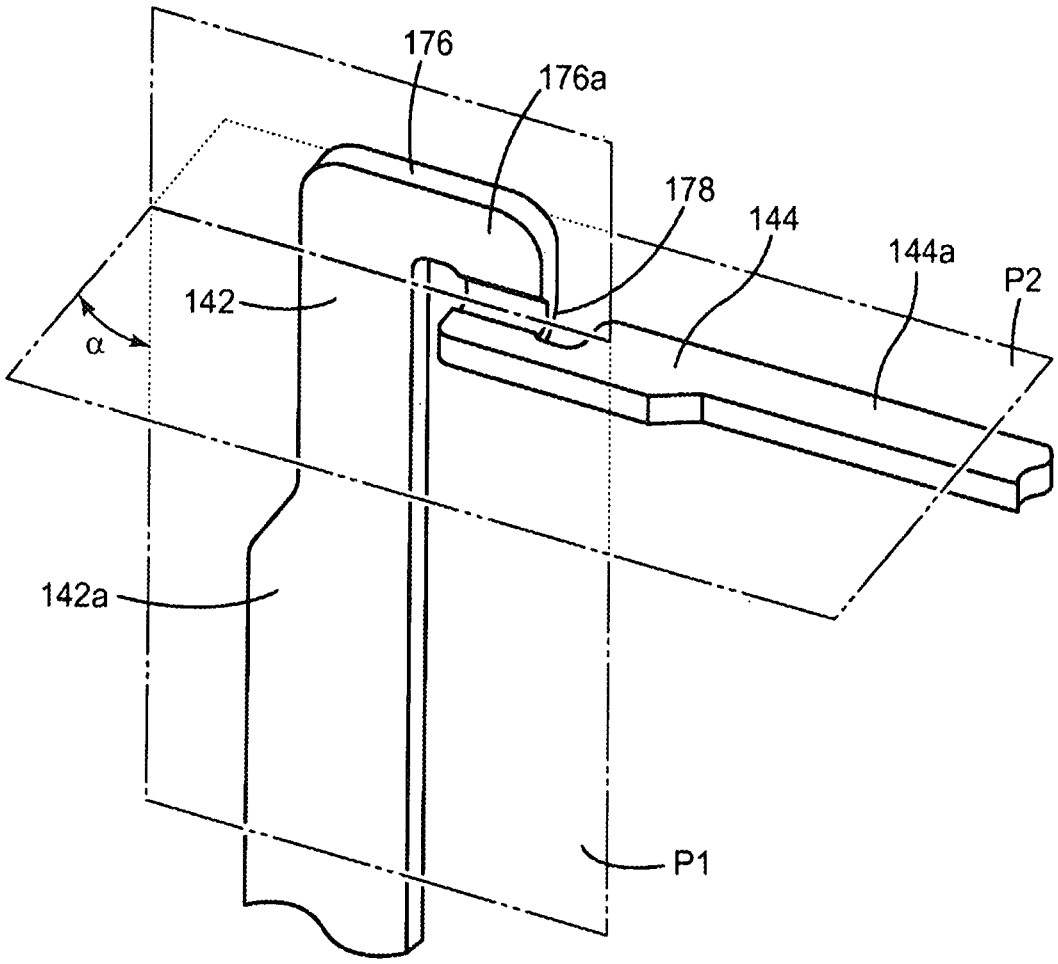
FIG. 6 is a perspective detailed view of the electrical contact of FIG. 5.

Referring to FIGS. 5 and 6, the electrical contacts of first and second sets of electrical contacts 122, 124 of electrical connector 100 will now be further described, using an electrical contact of the first set of electrical contacts 122 as an example. First body portion 142 has a major surface 142*a* generally lying in a first plane P1. Second body portion 144 has a major surface 144*a* generally lying in a second plane P2 intersecting first plane P1. In the embodiment illustrated in FIG. 5, angle α (illustrated in FIG. 6) between first plane P1 and second plane P2 is about 90°, which contributes to the electrical performance improvement of the electrical contact and the electrical connector and electrical connector system in which the electrical contact is used. An electrical performance improvement also exists in embodiments wherein angle α is less than about 90° or more than about 90°. In some embodiments, angle α is more than about 15°.

In some embodiments, angle α is more than about 60°. To enable second plane P2 to intersect first plane P1, the electrical contact may include a transition portion 176 disposed between first body portion 142 and second body portion 144. In one aspect, transition portion 176 connects first body portion 142 to second body portion 144. In one aspect, when first body portion 142 facilitates broadside coupling of the electrical contact and second body portion 144 facilitates edge coupling of the electrical contact, transition portion 176 connects the broadside coupled portion of the electrical contact to the edge coupled portion of the electrical contact. In the embodiment illustrated in FIG. 5, transition portion 176 is a generally U-shaped portion. The U-shape provides a mechanically and electrically effective transition between first body portion 142 and second body portion 144. In other embodiments, transition portion 176 may have other suitable shapes, and first body portion 142 and second body portion 144 may be connected in other suitable ways. In some embodiments, transition portion 176 includes a coined portion 178 (best illustrated in FIG. 6). Coined portion 178 is configured to facilitate positioning of second body portion 144 with respect to first body portion 142 in the process of making the electrical contact. In an exemplary method of making the electrical contact, the thickness of the electrical contact is reduced in coined portion 178, which enables the material in coined portion 178 to be effectively bent to accurately position second body portion 144 with respect to first body portion 142.

In some embodiments, the electrical contacts in each set of electrical contacts are arranged in a ground-signal-ground-signal (G-S-G-S) arrangement. In this arrangement, the signal contacts (S) may be configured to carry signals for use in single ended applications, and the ground contacts (G) provide ground return paths for the signals. In this single ended arrangement, although a net current flow exists through the ground contacts (G), which makes the arrangement susceptible to crosstalk and ground bounce, the signal density is maximized. In one aspect, broadside coupling may take place between the first body portions of adjacent electrical contacts, and edge coupling may take place between the second body portions of adjacent electrical contacts. For example, in a ground-signal-ground-signal (G-S-G-S) arrangement, broadside and edge coupling may take place between a signal contact (S) and the adjacent ground contacts (G). In one aspect, although the first body portions and the second body portions are on the same pitch, the first body portions of adjacent electrical contacts are more strongly coupled than the second body portions of adjacent electrical contacts, because the surface areas that face each other are larger.

In some embodiments, the electrical contacts in each set of electrical contacts are arranged in a ground-signal-signal-ground (G-S-S-G) arrangement. In this arrangement, the signal contacts (S) of each pair of signal contacts (S-S) may be configured to carry opposite polarity versions of the same signal for use in differential applications. In this differential pair arrangement, although the signal density is approximately half of that in a single ended arrangement, ground return paths are not required. Even if the ground contacts (G) provide ground return paths for the signals, no net current flow exists through the ground contacts (G), because the current flow associated with the positive polarity signals cancels the current flow associated with the negative polarity signals. Therefore, ground bounce is eliminated and the crosstalk immunity is much better than in a single ended arrangement. In one aspect, broadside coupling may take place between the first body portions of adjacent electrical contacts, and edge coupling may take place between the second body portions of adjacent electrical contacts. For example, in a ground-signal-signal-ground (G-S-S-G) arrangement, broadside and edge coupling may take place between a signal contact (S) and the adjacent signal contact (S) and ground contact (G).

Electrical contacts according to aspects of the present invention that include a longitudinal first body portion configured for broadside coupling and a longitudinal second body portion configured for edge coupling and extending from the longitudinal first body portion provide a significant improvement in electrical performance over conventional electrical contacts. Electrical performance of electrical contacts, electrical connectors, and electrical connector systems according to aspects of the present invention may be defined by electrical performance characteristics such as, e.g., impedance value and control, insertion loss (S-parameter $S_{21}$), return loss (S-parameter $S_{11}$), and crosstalk. FIGS. 16*a*-16*d* are graphs illustrating the improved performance of an electrical connector system according to an aspect of the present invention.

Figure 16A:
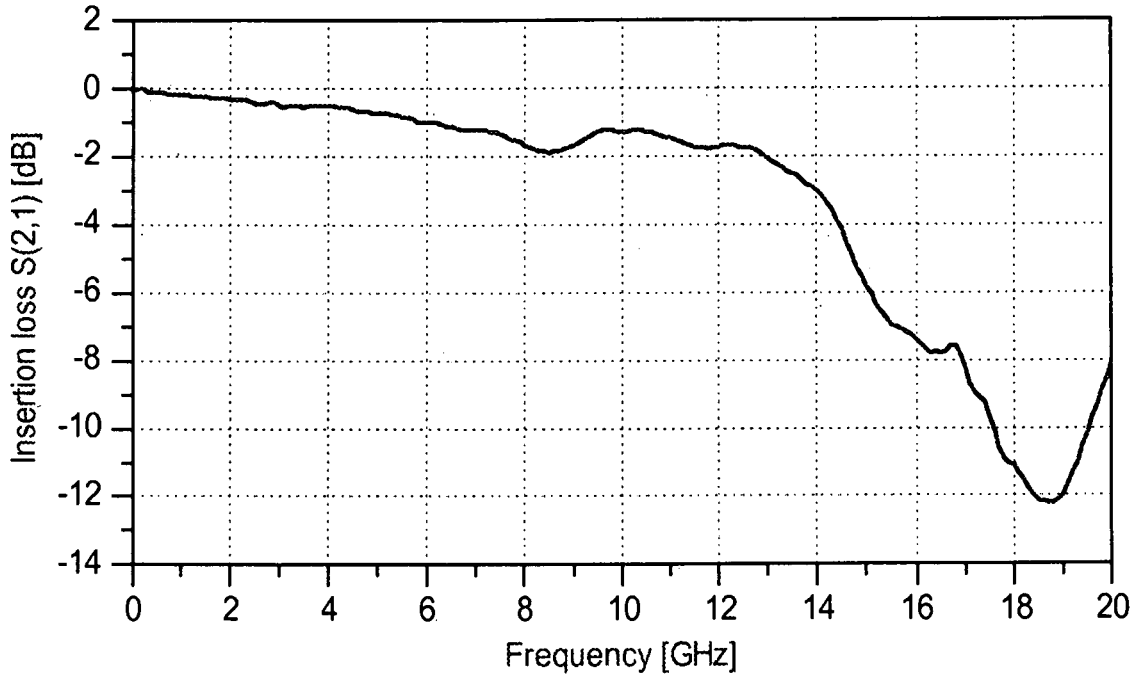
FIGS. 16*a*-16*d* are graphs illustrating the improved performance of an electrical connector system according to an aspect of the present invention.
Figure 16B:
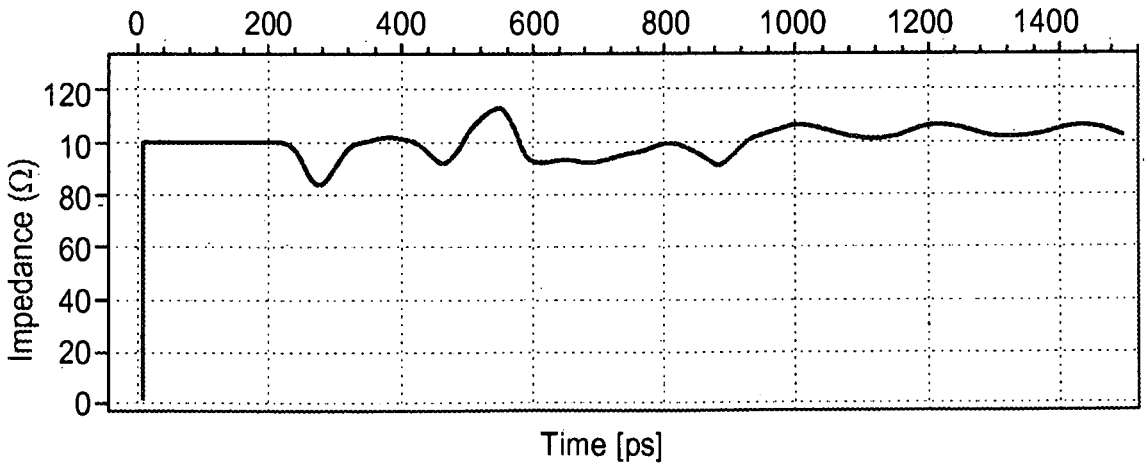
Figure 16C:
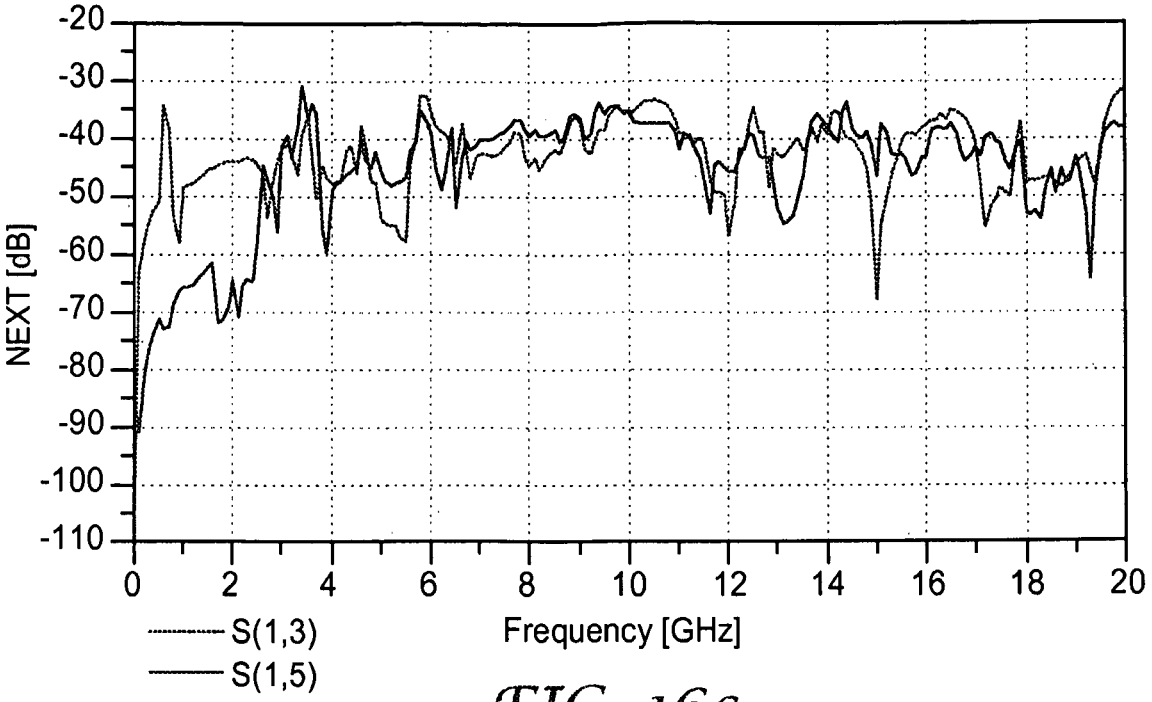
Figure 16D:
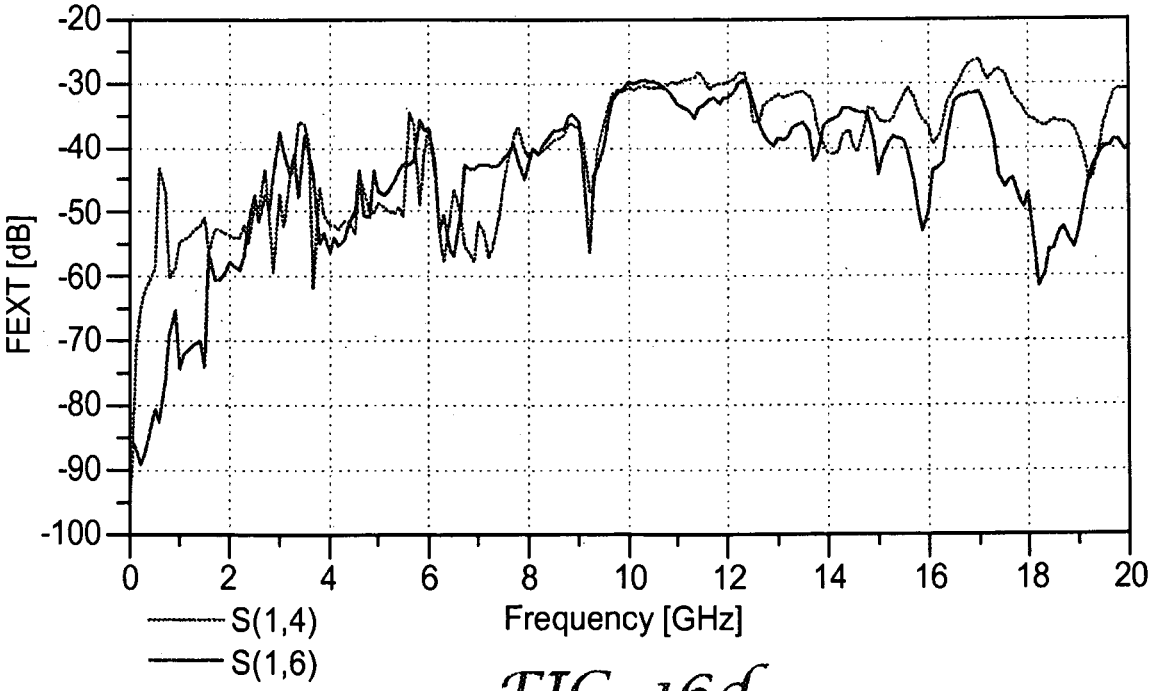

In some embodiments, using first set of electrical contacts 122 as an example, first body portion 142 is configured for broadside coupling, and second body portion 144 is configured for edge coupling and extends from first body portion 142, such that an $S_{21}$ of the electrical contact, the electrical connector, or the electrical connector system is less than about 2 dB for frequencies less than about 10 GHz, as illustrated in FIG. 16*a*. In some embodiments, using first set of electrical contacts 122 as an example, first body portion 142 is configured for broadside coupling, and second body portion 144 is configured for edge coupling and extends from first body portion 142, such that an impedance of the electrical contact, the electrical connector, or the electrical connector system is between about 40Ω and about 60Ω for a single ended application (not illustrated), and between about 80Ω and about 120Ω for a differential application, as illustrated in FIG. 16*b*. An electrical contact according to an aspect of the present invention that uses a combination of broadside coupling and edge coupling may provide a superb control of the impedance over a wide range of signal rise times. For example, a differential impedance of about 100Ω±15Ω may be achieved for a signal rise time of about 35 picoseconds. In some embodiments, using first set of electrical contacts 122 as an example, first body portion 142 is configured for broadside coupling, and second body portion 144 is configured for edge coupling and extends from first body portion 142, such that a crosstalk of the electrical contact, the electrical connector, or the electrical connector system is less than about −30 dB for frequencies up to about 20 GHz, as illustrated in FIGS. 16*c* and 16*d*, illustrating near end crosstalk (NEXT) and far end crosstalk (FEXT), respectively.

Referring again to FIGS. 5 and 6, in some embodiments, a broader side of longitudinal first body portion 142 generally defines a first plane P1, and a broader side of longitudinal second body portion 144 generally defines a second plane P2 intersecting first plane P1. In some embodiments, the electrical contact further includes a generally U-shaped transition portion 176. Transition portion 176 connects first body portion 142 and second body portion 144. A major surface 176*a* of transition portion 176 generally lies in first plane P1. In some embodiments, second body portion 144 extends transversely from first body portion 142. In one aspect, this may enable the electrical contact to be used in both vertical and right angle connector configurations. In some embodiments, second body portion 144 extends from first body portion 142 such that first body portion 142 is within a projected width $W_{B2}$ of second body portion 144 when viewed from a top of the electrical contact. In one aspect, this may be achieved by bending second body portion 144 about its longitudinal center line with respect to first body portion 142. This configuration enables a relatively wide contact portion, which provides a reliable interconnection, without increasing the footprint of the connector on a PCB.

Figure 7:
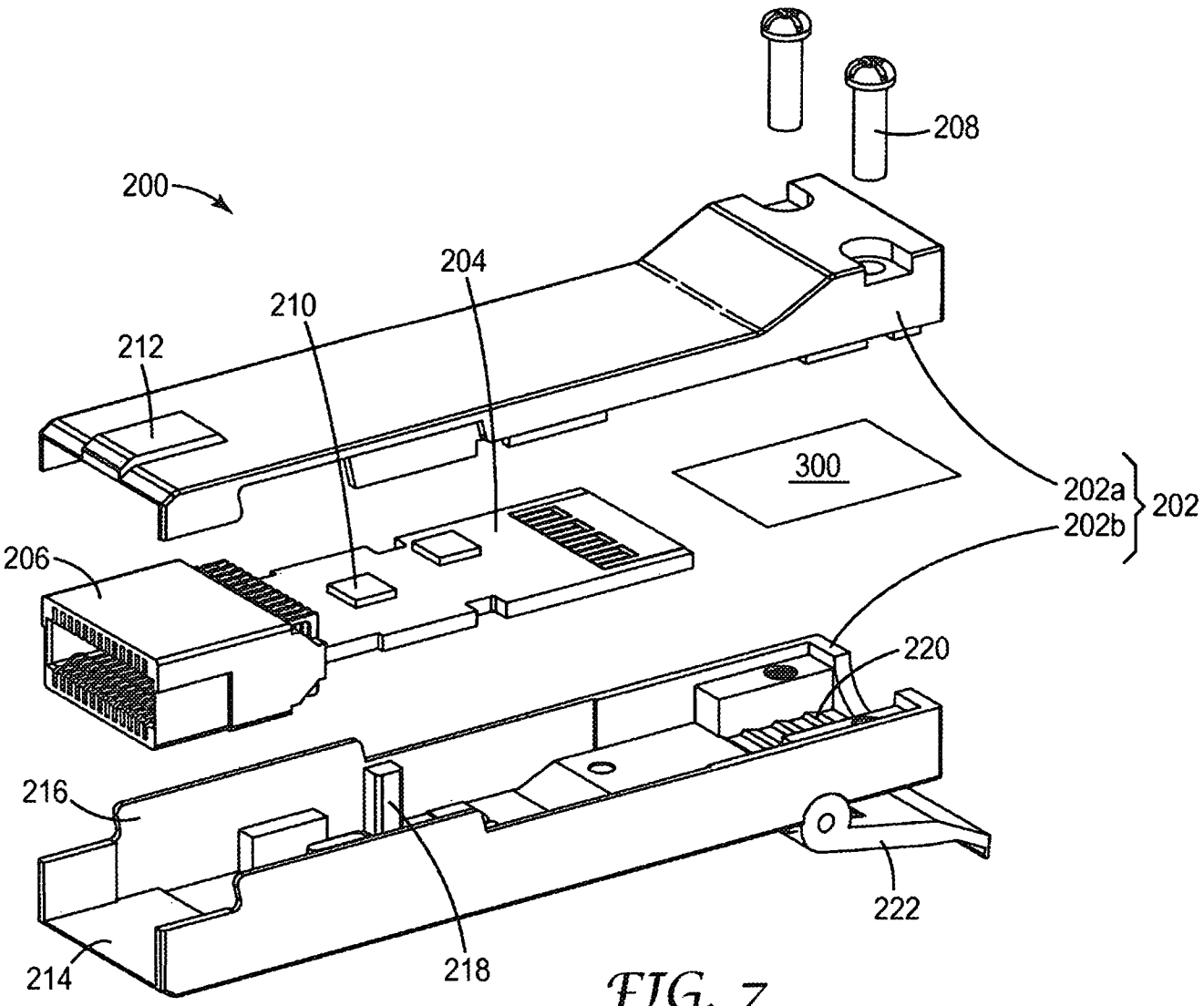
FIG. 7 is an exploded top perspective view of the mating connector assembly of FIG. 1.
Figure 8:
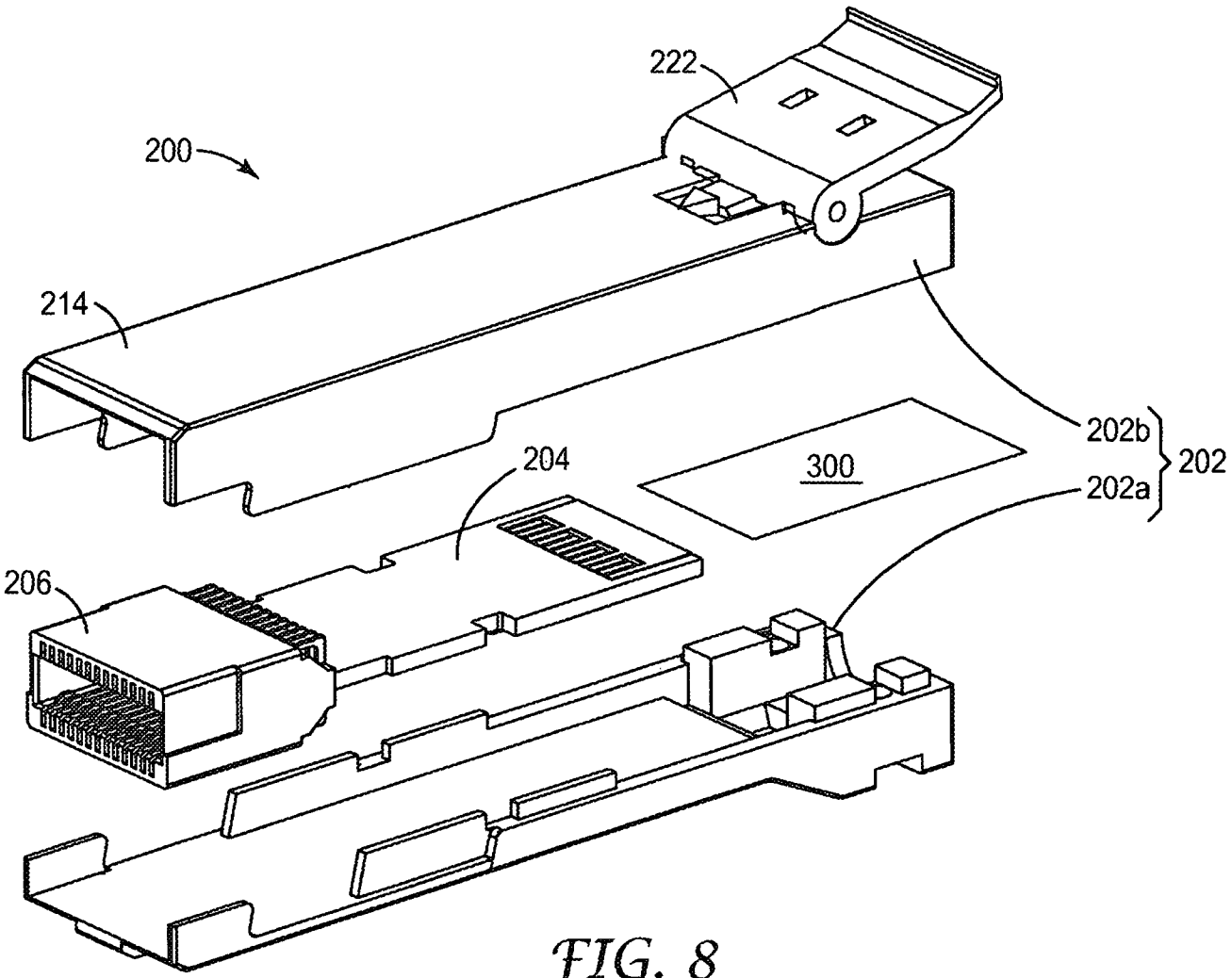
FIG. 8 is an exploded bottom perspective view of the mating connector assembly of FIG. 1.

With reference to FIGS. 7 and 8, an exemplary embodiment of a mating connector assembly 200 according to an aspect of the present invention includes a cable housing 202 enclosing a PCB 204 coupled to a mating connector 206 at one end and a shielded cable 300 at another end, wherein cable housing 202 further includes a top cover 202*a* and a bottom cover 202*b*, whereby top cover 202*a* may be coupled to bottom cover 202*b* by a coupling device. The coupling device may include, for example, a plurality of screws 208, as illustrated in FIG. 7.

PCB 204 may be of flexible or rigid substrate. In some embodiments, PCB 204 includes a plurality of equalization devices 210 which may be of active or passive nature and may be used to control the amplitude of the electrical signals to stay within a predefined range. Optionally, equalization devices 210, if they are of active nature, may be used for other forms of signal equalization such as, for example, signal regeneration.

In some embodiments, top cover 202*a* and bottom cover 202*b* of cable housing 202 are metallic. In this case, the mating connector assembly 200 can be grounded when cable housing 202 is engaged with complementary parts which have a ground connection such as a metal cage (not illustrated but known to a person of ordinary skill in the art) enclosing electrical connector 100 on a PCB (not illustrated) or a plurality of braided cables (not illustrated) in shielded cable 300. Additionally, a metallic cable housing 202 can shield PCB 204, mating connector 206 and equalization devices 210 within cable housing 202 from external electromagnetic interference (EMI).

In some embodiments, top cover 202*a* includes a plurality of assembly guides 212 on one side thereof to facilitate the mating of mating connector assembly 200 with a metal cage (not illustrated) housing electrical connector 100 on a PCB of an electronic device (not illustrated) when in use. Similar in function to cable housing 202, the metal cage provides EMI shielding for electrical connector 100 from the external environment. It is worthwhile to note that assembly guides 212 may vary in number, shape and form and are not limited to the number, shape and form illustrated in FIG. 7.

In some embodiments, bottom cover 202*b* includes a base 214, a plurality of walls 216 extending vertically from base 214 and a plurality of restricting devices to restrict the movement of PCB 204 within cable housing 202. In some embodiments, the restricting devices include a plurality of protrusions 218 extending from walls 216. In some embodiments, the restricting devices include a plurality of teeth 220 extending from one side of base 214 of bottom cover 202*b*. When top cover 202*a* is coupled to bottom cover 202*b*, teeth 220 bite into shielded cable 300 further preventing any movement of PCB 204 within cable housing 202. It is worthwhile to note that the restricting devices may vary in number, shape and form and are not limited to the number, shape and form illustrated in FIG. 7.

In some embodiments, on another side of base 214, bottom cover 202*b* includes a latching mechanism 222 which may be used to couple/de-couple mating connector assembly 200 to/from the metal cage (not illustrated) housing electrical connector 100 on a PCB of an electronic device (not illustrated).

Figure 9:
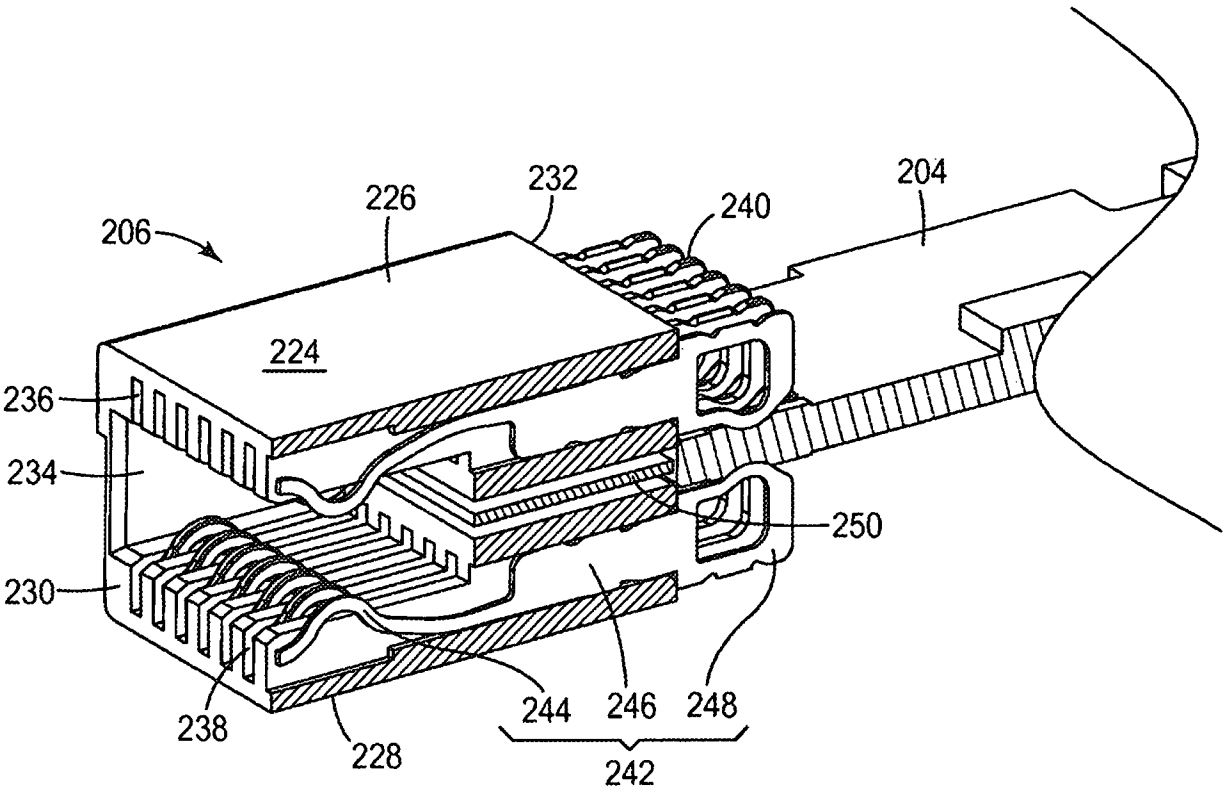
FIG. 9 is a perspective cut-away detailed view of the mating connector assembly of FIG. 1.
Figure 10:
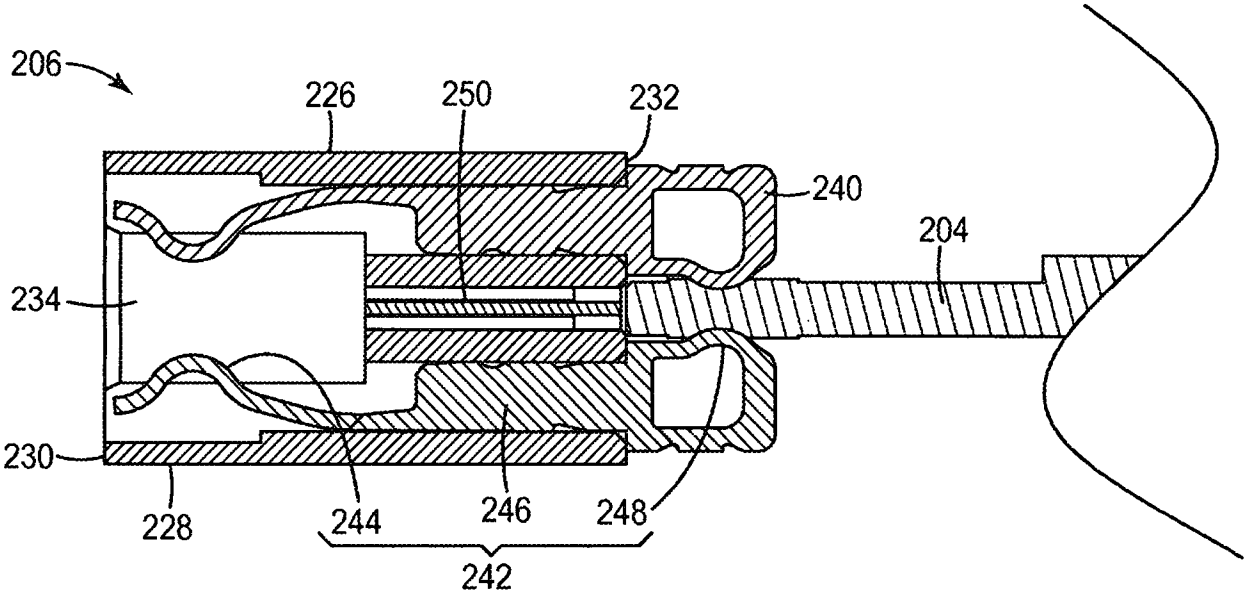
FIG. 10 is a side cross-sectional detailed view of the mating connector assembly of FIG. 1.

FIGS. 9 and 10 show a perspective cut-away detailed view and a side cross-sectional detailed view, respectively, of mating connector 206. While a socket connector is used to explain and illustrate mating connector 206, it is possible to replace the socket connector with a header connector and/or use a hybrid connector that functions both as a socket connector and a header connector, without changing the spirit of the invention.

With reference to FIGS. 9 and 10, mating connector 206 includes an insulative housing 224, in some embodiments formed from a dielectric material, having a top 226, a bottom 228 and two sidewalls interconnecting to form a mating face 230 at one end and a rear face 232 at another end. At mating face 230, there is a mating slot 234 formed for receiving a complementary connector such as, for example, electrical connector 100. Extending from, at or near mating face 230 to rear face 232, insulative housing 224 further includes a first set of channels 236 and a second set of channels 238 formed at top 226 and at bottom 228, respectively, of the housing.

Mounted in first set of channels 236 and second set of channels 238 is a plurality of contacts arranged in two distinct sets with a first set of contacts 240 mounted in first set of channels 236 and a second set of contacts 242 mounted in second set of channels 238. In some embodiments, each contact includes a front portion 244, a middle portion 246 and an end portion 248, wherein front portion 244 serves to connect mating connector 206 electrically to a complementary connector via the corresponding contact on the complementary connector, middle portion 246 serves to anchor each contact to insulative housing 224 and end portion 248 is mounted to PCB 204 so as to connect the contact of mating connector 206 to the corresponding conductive pad formed on PCB 204. While sets of contacts 240, 242 are illustrated to be straddle-mounted to PCB 204 in FIGS. 9 and 10, other forms of mounting sets of contacts 240, 242 to PCB 204 are also possible and are within the scope of the invention.

In some embodiments, within insulative housing 224 of mating connector 206, there is a shielding device to minimize the electrical signals of first set of contacts 240 from interfering with the electrical signals of second set of contacts 242 (a phenomenon also known as crosstalk) and vice versa. The need to minimize crosstalk becomes important when handling high speed data exchange or when handling signals which have a rise time of 30 picoseconds or more, for example. In the embodiment illustrated in FIGS. 9 and 10, the shielding device may be a shielding plate 250 sandwiched between first set of contacts 240 and second set of contacts 242.

Figure 11:
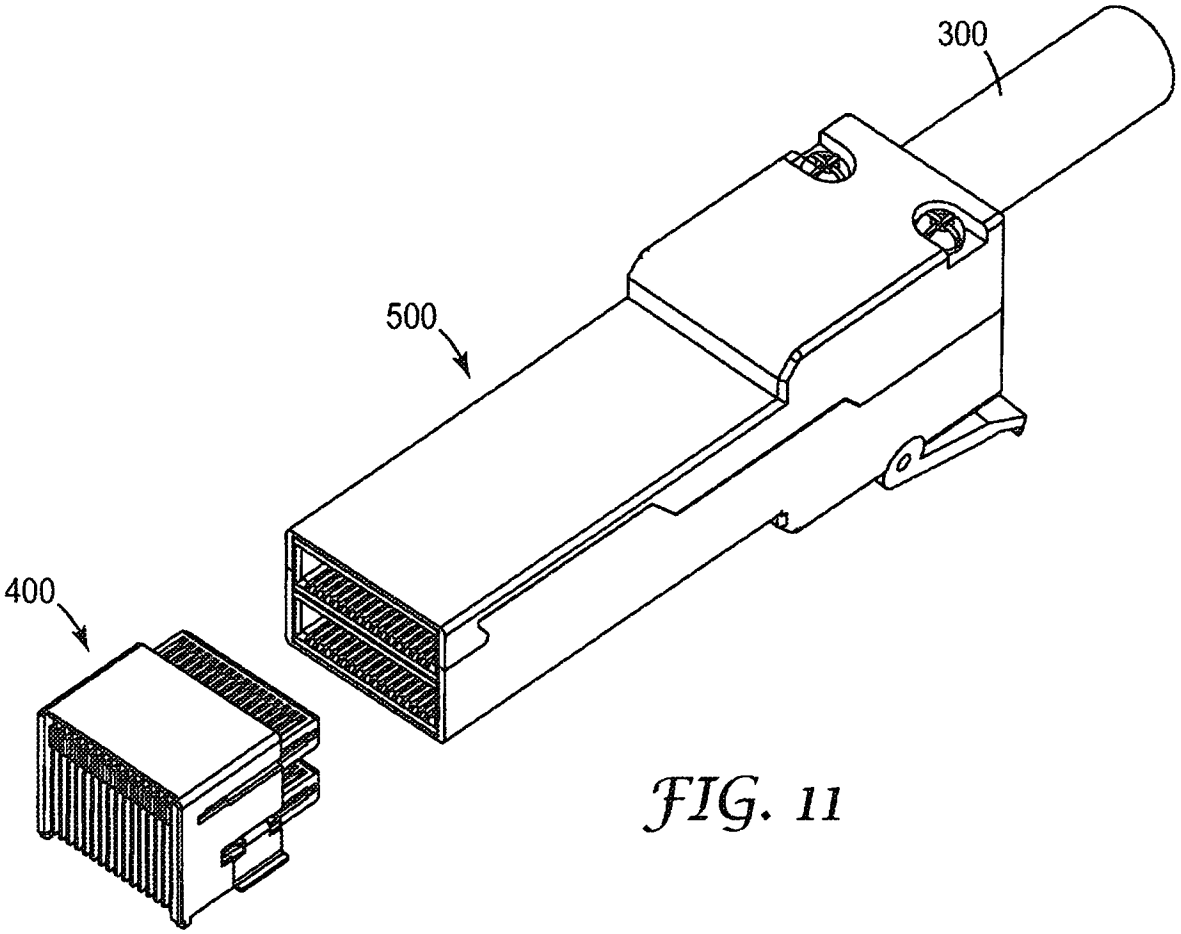
FIG. 11 is a top perspective view of another exemplary embodiment of an electrical connector system according to an aspect of the present invention including an electrical connector and a mating connector assembly positioned for mating with the electrical connector.

FIG. 11 illustrates another exemplary embodiment of an electrical connector system according to an aspect of the present invention including an electrical connector 400 and a mating connector assembly 500 positioned for mating with electrical connector 400. In some embodiments, electrical connector 400 is configured for mounting on a PCB (not illustrated), and mating connector assembly 500 is configured for coupling to a shielded cable 300.

Figure 12:
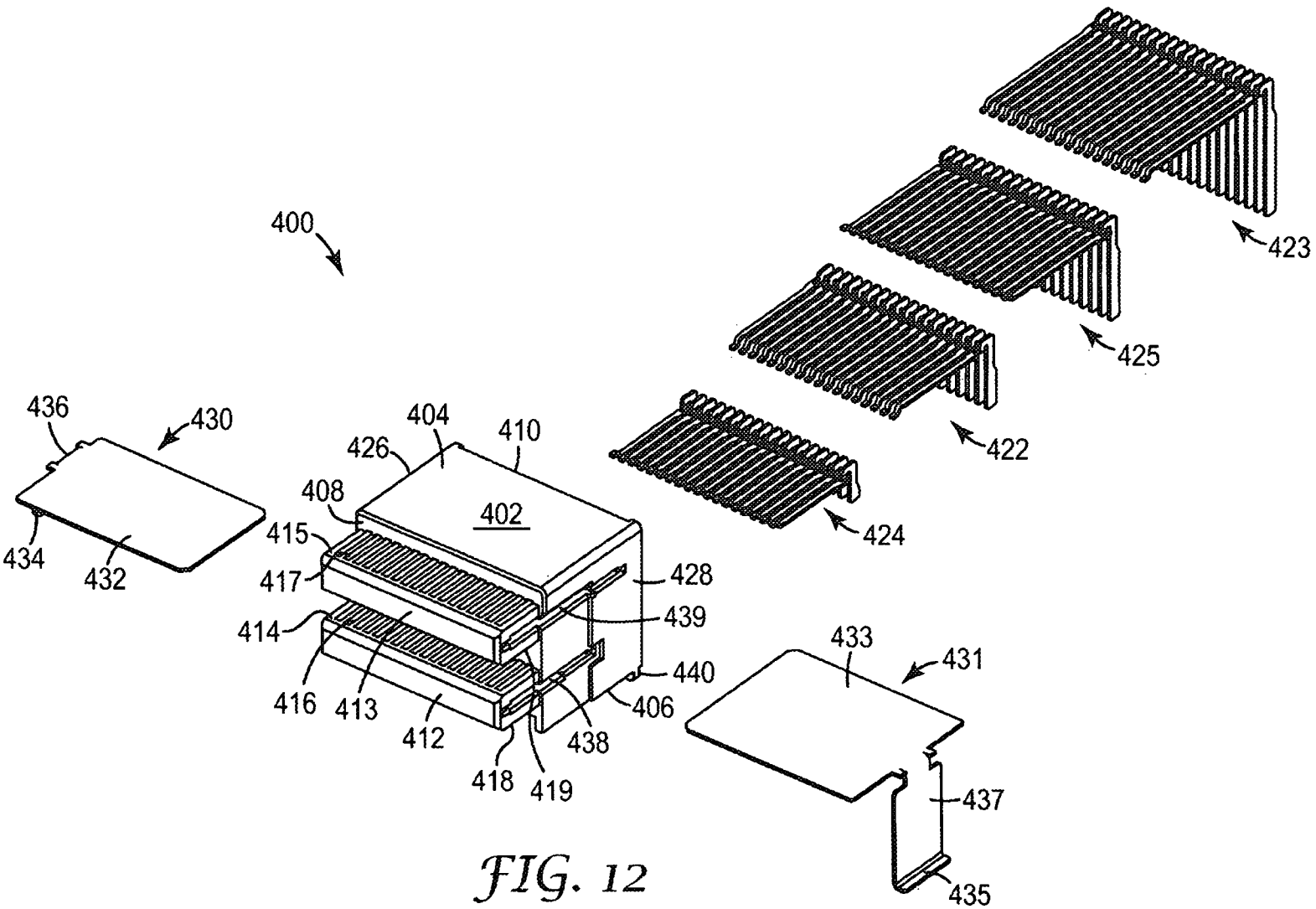
FIG. 12 is an exploded top perspective view of the electrical connector of FIG. 11.
Figure 13:
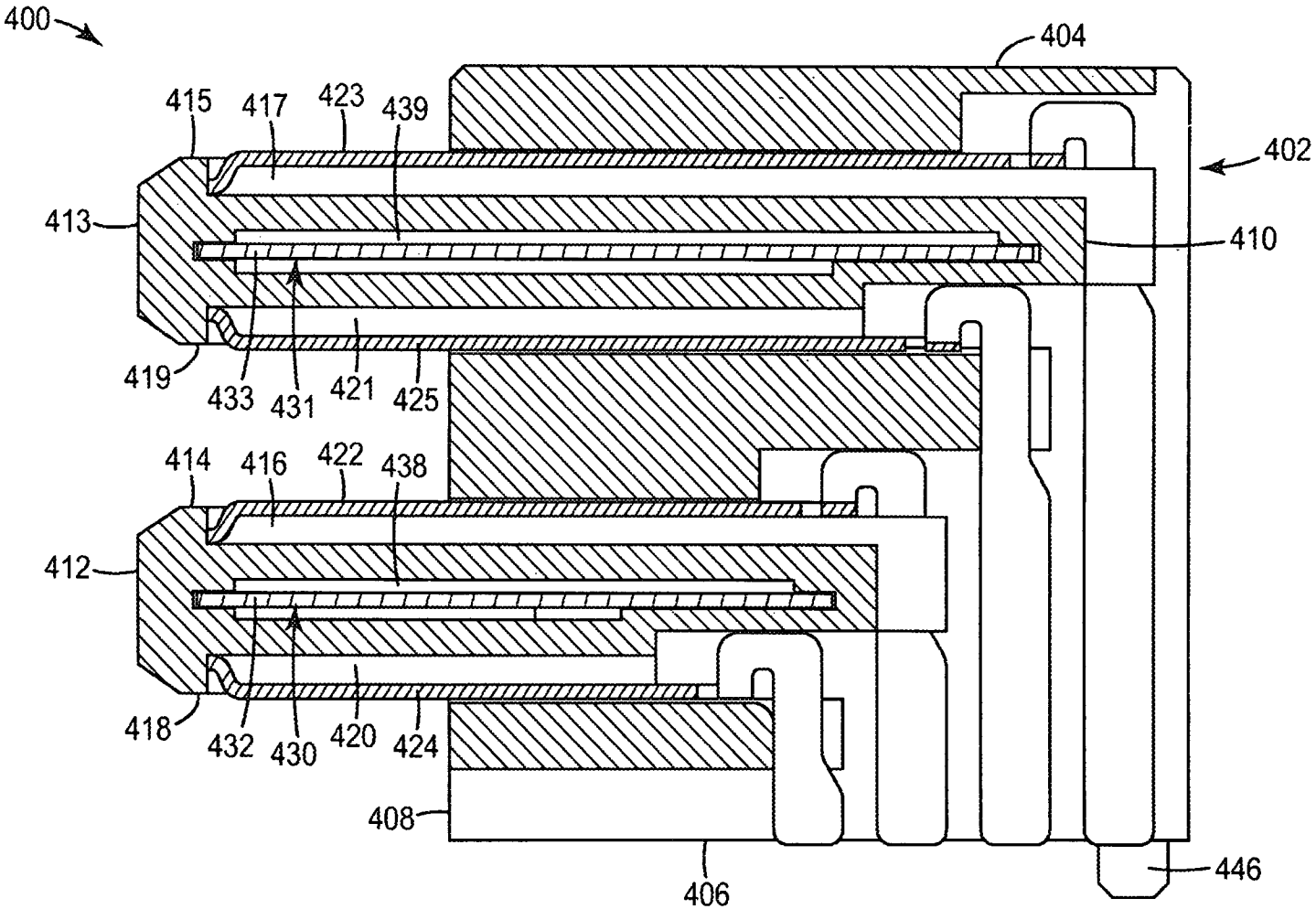
FIG. 13 is a side cross-sectional view of the electrical connector of FIG. 11.

With reference to FIGS. 12 and 13, an exemplary embodiment of an electrical connector 400 according to an aspect of the present invention includes an insulative body 402, in some embodiments formed from a dielectric material, having a top 404, a bottom 406, a front face 408 and a rear face 410. Extending from front face 408 away from insulative body 402 is a plurality of tongues 412, 413 each having a top tongue surface 414, 415 with a first set of tongue slots 416, 417 which extends from tongue 412, 413 into insulative body 402 and a bottom tongue surface 418, 419 with a second set of tongue slots 420, 421 (illustrated in FIG. 13) aligned to first set of tongue slots 416, 417 and extending from tongue 412, 413 into insulative body 402. Mounted in each set of tongue slots 416, 417, 420, 421 is a set of electrical contacts 422, 423, 424, 425, respectively. In some embodiments, the electrical contacts have features and functions similar to the electrical contacts of first set of electrical contacts 122 and second set of electrical contacts 124 of electrical connector 100 described above.

Electrical connector 400 further includes a first body side 426, a second body side 428 and lateral slots extending from one body side of the connector, wherein the lateral slots are configured to receive a ground member. In some embodiments, the ground member includes a lateral portion which is inserted into the lateral slot in electrical connector 400, a tail portion for bonding electrical connector 400 to a PCB and a body portion connecting the lateral portion to the tail portion.

In the embodiment illustrated in FIGS. 12 and 13, a first ground member 430 includes a lateral portion 432, a tail portion 434, and a body portion 436 connecting lateral portion 432 to tail portion 434. Lateral portion 432 is inserted in a first lateral slot 438 which extends in electrical connector 400 from first body side 426 to second body side 428 between first set of tongue slots 416 and second set of tongue slots 420. A second ground member 431 includes a lateral portion 433, a tail portion 435, and a body portion 437 connecting lateral portion 433 to tail portion 435. Lateral portion 433 is inserted in a second lateral slot 439 which extends in electrical connector 400 from first body side 426 to second body side 428 between first set of tongue slots 417 and second set of tongue slots 421. Lateral portions 432, 433 extend from first body side 426 to second body side 428. Tail portions 434, 435 when bonded to a PCB secure electrical connector 400 to the PCB. Different ways of bonding tail portions 434, 435 to a PCB may be used, such as, for example, soldering. In some embodiments, insulative body 402 and ground members 430, 431 have features and functions similar to insulative body 102 and ground member 130 of electrical connector 100 described above.

Figure 14:
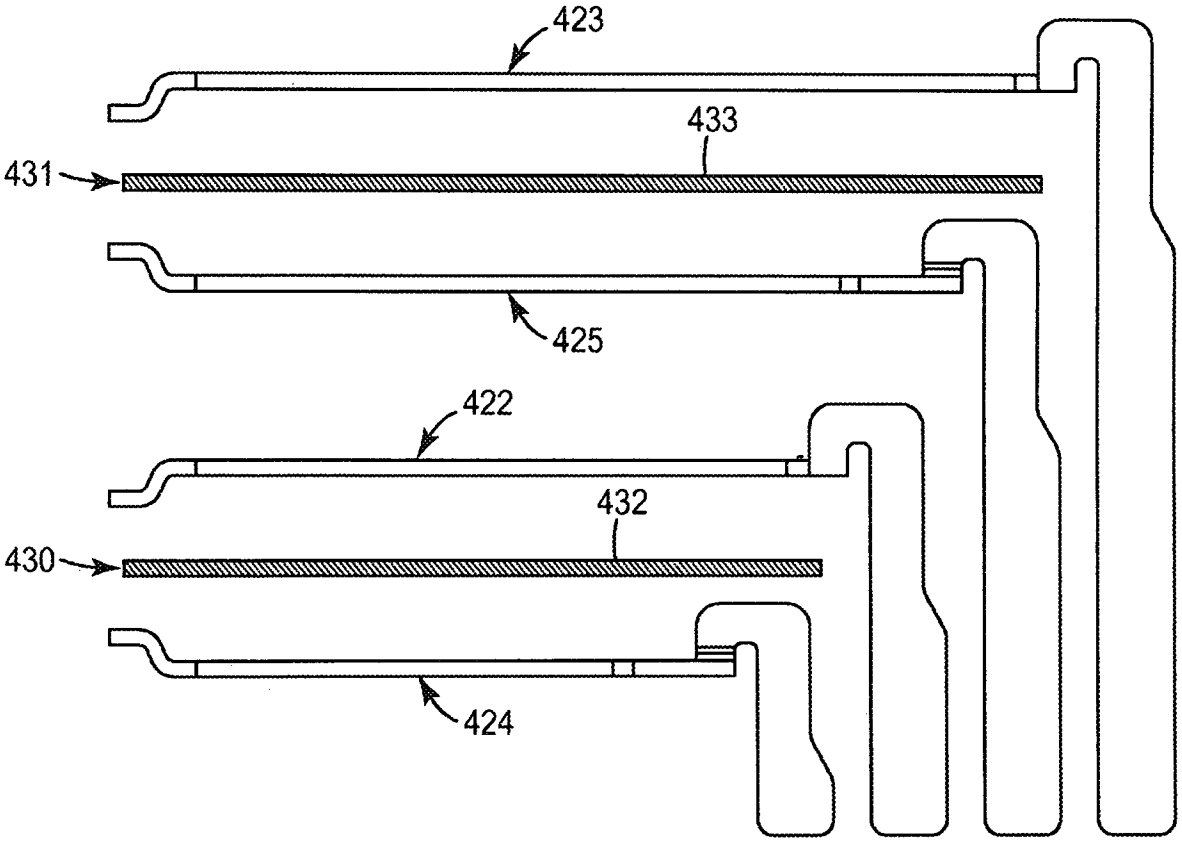
FIG. 14 is a side view of the electrical contacts and ground members of the electrical connector of FIG. 11.

FIG. 14 is a side view illustrating sets of electrical contacts 422, 423, 424, 425 and ground members 430, 431 of electrical connector 400. While the features of the electrical contacts and the ground members are similar, the configuration and physical dimensions of these features may be different, e.g., to accommodate physical space requirements and/or electrical performance requirements. For example, to minimize crosstalk between the first set of electrical contacts the second set of electrical contacts, it is beneficial for the second body portion of the first set of electrical contacts and the second body portion of the second set of electrical contacts to extend substantially along a width of the lateral portion of the corresponding ground member, as illustrated in FIG. 14. To accommodate this in electrical connector 400, lateral portion 432 of first ground member 430 and lateral portion 433 of second ground member 431 have different widths.

Although exemplary embodiments of an electrical contact according to aspects of the present invention are described and illustrated herein as being part of a set of electrical contacts of electrical connector 100 or electrical connector 400, it is within the scope of the invention to include a plurality of these electrical contacts in any suitable electrical connector, such as, e.g., a single row connector, a multi (e.g., two or four) row connector, a vertical connector, or a right angle connector.

Figure 15:
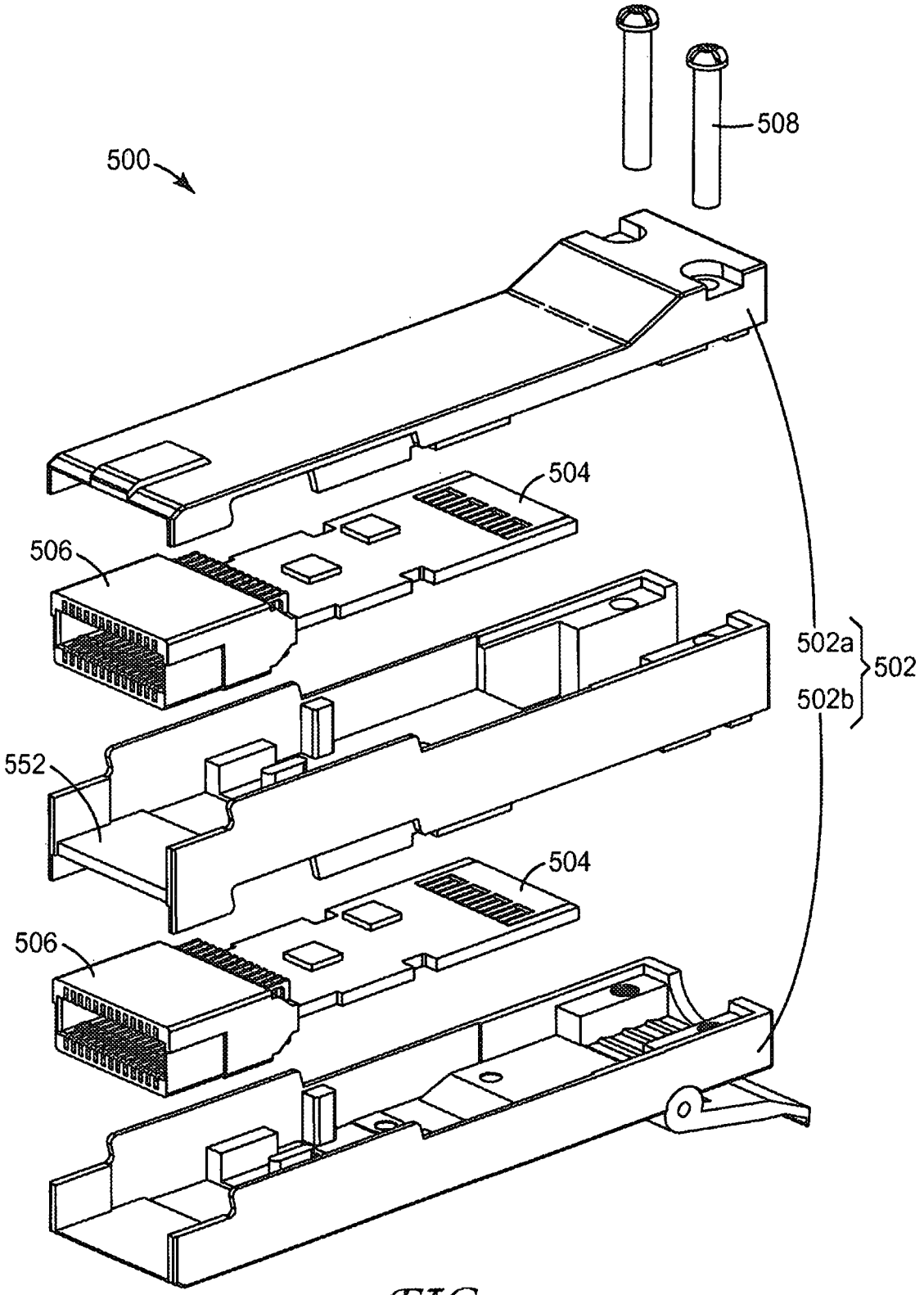
FIG. 15 is an exploded top perspective view of the mating connector assembly of FIG. 11.

With reference to FIG. 15, an exemplary embodiment of a mating connector assembly 500 according to an aspect of the present invention includes a cable housing 502 enclosing two PCBs 504 each coupled to a mating connector 506 at one end and a shielded cable 300 at another end, wherein cable housing 502 further includes a top cover 502*a* and a bottom cover 502*b*, whereby top cover 502*a* may be coupled to bottom cover 502*b* by a coupling device. The coupling device may include, for example, a plurality of screws 508, as illustrated in FIG. 15. Mating connector assembly 500 further includes a system separator 552 between each assembly of mating connector 506 and PCB 504, which may provide grounding and EMI shielding. In some embodiments, top cover 502*a*, bottom cover 502*b*, PCBs 504, and mating connectors 506 are identical to top cover 202*a*, bottom cover 202*b*, PCB 204, and mating connector 206, respectively, of mating connector assembly 200 described above.

In each of the embodiments and implementations described herein, the various components of the electrical connector and elements thereof are formed of any suitable material. The materials are selected depending upon the intended application and may include both metals and non-metals (e.g., any one or combination of non-conductive materials including but not limited to polymers, glass, and ceramics). In some embodiments, electrically insulative components, such as, e.g., insulative bodies 102, 402, and insulative housing 224, are formed of a polymeric material by methods such as injection molding, extrusion, casting, machining, and the like, while electrically conductive components, such as, e.g., sets of electrical contacts 122, 124, 422, 423, 424, 425, sets of contacts 240, 242, ground members 130, 430, 431, and shielding plate 250, are formed of metal by methods such as molding, casting, stamping, machining, and the like. Material selection will depend upon factors including, but not limited to, chemical exposure conditions, environmental exposure conditions including temperature and humidity conditions, flame-retardancy requirements, material strength, and rigidity, to name a few.

Unless otherwise indicated, all numbers expressing quantities, measurement of properties, and so forth used in the specification and claims are to be understood as being modified by the term "about". Accordingly, unless indicated to the contrary, the numerical parameters set forth in the specification and claims are approximations that can vary depending on the desired properties sought to be obtained by those skilled in the art utilizing the teachings of the present application. Not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, to the extent any numerical values are set forth in specific examples described herein, they are reported as precisely as reasonably possible. Any numerical value, however, may well contain errors associated with testing or measurement limitations.

Following are exemplary embodiments of an electrical contact, an electrical connector, or an electrical connector system according to aspects of the present invention.

Embodiment 1 is an electrical contact comprising: a longitudinal first body portion having a terminal end, a first transition end opposite the terminal end, and a major surface generally lying in a first plane; a longitudinal second body portion having a contact end, a second transition end opposite the contact end, and a major surface generally lying in a second plane intersecting the first plane, the contact end being distal to the first transition end; a terminal portion extending from the first body portion at the terminal end; and a contact portion extending from the second body portion at the contact end.

Embodiment 2 is the electrical contact of embodiment 1, wherein an angle between the first plane and the second plane is more than about 15°.

Embodiment 3 is the electrical contact of embodiment 1, wherein an angle between the first plane and the second plane is more than about 60°.

Embodiment 4 is the electrical contact of embodiment 1, wherein an angle between the first plane and the second plane is about 90°.

Embodiment 5 is the electrical contact of embodiment 1 further comprising a transition portion disposed between the first body portion and the second body portion.

Embodiment 6 is the electrical contact of embodiment 5, wherein the transition portion is a generally U-shaped portion.

Embodiment 7 is the electrical contact of embodiment 5, wherein the transition portion includes a coined portion configured to facilitate positioning of the second body portion with respect to the first body portion.

Embodiment 8 is the electrical contact of embodiment 1, wherein the first body portion is configured to facilitate broadside coupling of the electrical contact, and the second body portion is configured to facilitate edge coupling of the electrical contact.

Embodiment 9 is the electrical contact of embodiment 1, wherein the terminal portion is configured to provide one of a surface-mount connection and a through-hole connection.

Embodiment 10 is the electrical contact of embodiment 1, wherein the second body portion is resilient.

Embodiment 11 is an electrical connector comprising a plurality of the electrical contacts of embodiment 1.

Embodiment 12 is the electrical connector of embodiment 11, wherein the first body portion of each electrical contact is positioned to facilitate broadside coupling between adjacent electrical contacts, and the second body portion of each electrical contact is positioned to facilitate edge coupling between adjacent electrical contacts.

Embodiment 13 is the electrical connector of embodiment 11, wherein the electrical contacts are arranged in a ground-signal-signal-ground (G-S-S-G) arrangement.

Embodiment 14 is the electrical connector of embodiment 11, wherein the electrical contacts are arranged in a ground-signal-ground-signal (G-S-G-S) arrangement.

Embodiment 15 is an electrical connector comprising: an insulative body having a front face; a tongue extending from the front face in a direction away from the insulative body, the tongue having a top tongue surface and a bottom tongue surface; and one set of electrical contacts disposed in one set of tongue slots incorporated at the top tongue surface of the tongue and another set of electrical contacts disposed in another set of tongue slots incorporated at the bottom tongue surface of the tongue, wherein the tongue slots incorporated at the bottom tongue surface are aligned to the tongue slots incorporated at the top tongue surface, and wherein each electrical contact includes: a longitudinal first body portion having a terminal end, a first transition end opposite the terminal end, and a major surface generally lying in a first plane; a longitudinal second body portion having a contact end, a second transition end opposite the contact end, and a major surface generally lying in a second plane intersecting the first plane, the contact end being distal to the first transition end; a terminal portion extending from the first body portion at the terminal end; and a contact portion extending from the second body portion at the contact end.

Embodiment 16 is the electrical connector of embodiment 15 further comprising a lateral slot in the insulative body configured to receive a ground member, wherein the ground member comprises a lateral portion which is inserted into the lateral slot, a tail portion for attaching the electrical connector to a printed circuit board, and a body portion connecting the lateral portion to the tail portion.

Embodiment 17 is the electrical connector of embodiment 16, wherein the lateral slot is between the one set of tongue slots and the other set of tongue slots.

Embodiment 18 is the electrical connector of embodiment 16, wherein the second body portion extends substantially along a width of the lateral portion.

Embodiment 19 is the electrical connector of embodiment 15, wherein the first body portion of each electrical contact is positioned to facilitate broadside coupling between adjacent electrical contacts, and the second body portion of each electrical contact is positioned to facilitate edge coupling between adjacent electrical contacts.

Embodiment 20 is the electrical connector of embodiment 15, wherein the electrical contacts are arranged in a ground-signal-signal-ground (G-S-S-G) arrangement.

Embodiment 21 is the electrical connector of embodiment 15, wherein the electrical contacts are arranged in a ground-signal-ground-signal (G-S-G-S) arrangement.

Embodiment 22 is an electrical connector system comprising the electrical connector of embodiment 15, and a mating connector comprising: an insulative housing having a top, a bottom, and two side walls interconnecting to define a mating slot for receiving a complementary connector; one set of electrical contacts disposed in one set of channels incorporated at the top of the insulative housing, and another set of electrical contacts disposed in another set of channels incorporated at the bottom of the insulative housing; and a shielding device located between the one set of electrical contacts and the other set of electrical contacts.

Embodiment 23 is an electrical contact comprising: a longitudinal first body portion configured for broadside coupling; and a longitudinal second body portion configured for edge coupling and extending from the longitudinal first body portion, such that an $S_{21}$ of the electrical contact is less than about 2 dB for frequencies less than about 10 GHz.

Embodiment 24 is an electrical contact comprising: a longitudinal first body portion configured for broadside coupling; and a longitudinal second body portion configured for edge coupling and extending from the longitudinal first body portion, such that an impedance of the electrical contact is between about 40Ω and about 60Ω for a single ended application, and between about 80Ω and about 120Ω for a differential application.

Embodiment 25 is an electrical contact comprising: a longitudinal first body portion configured for broadside coupling; and a longitudinal second body portion configured for edge coupling and extending from the longitudinal first body portion, such that a crosstalk of the electrical contact is less than about −30 dB for frequencies up to about 20 GHz.

Embodiment 26 is the electrical contact of any one of embodiments 23 to 25, wherein a broader side of the longitudinal first body portion generally defines a first plane and a broader side of the longitudinal second body portion generally defines a second plane intersecting the first plane.

Embodiment 27 is the electrical contact of embodiment 26 further comprising a generally U-shaped transition portion connecting the longitudinal first and second body portions, wherein a major surface of the transition portion generally lies in the first plane.

Embodiment 28 is an electrical connector comprising a plurality of the electrical contacts of any one of embodiments 23 to 25.

Embodiment 29 is an electrical connector comprising: an insulative body; and at least one electrical contact disposed in the insulative body and comprising: a longitudinal first body portion configured for broadside coupling; and a longitudinal second body portion configured for edge coupling and extending from the first body portion, wherein the second body portion remains in a fixed position when engaged with a mating electrical contact.

Embodiment 30 is the electrical connector of embodiment 29, wherein a width of the second body portion is greater than a thickness of the second body portion.

Embodiment 31 is an electrical contact comprising: a longitudinal first body portion configured for broadside coupling; and a longitudinal second body portion configured for edge coupling and extending transversely from the first body portion.

Embodiment 32 is an electrical contact comprising: a longitudinal first body portion configured for broadside coupling; and a longitudinal second body portion configured for edge coupling and extending from the first body portion, such that the first body portion is within a projected width of the second body portion when viewed from a top of the electrical contact.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments illustrated and described without departing from the scope of the present invention. Those with skill in the mechanical, electro-mechanical, and electrical arts will readily appreciate that the present invention may be implemented it a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An electrical contact comprising:

a longitudinal first body portion elongated along a first direction and having a terminal end, a first transition end opposite the terminal end, and a major surface generally lying in a first plane;

a longitudinal second body portion elongated along a second direction, different from the first direction, and having a contact end, a second transition end opposite the contact end, and a major surface generally lying in a second plane intersecting the first plane, the contact end being distal to the first transition end;

a transition portion disposed between the first body portion and the second body portion, the transition portion including a bend of greater than 90 degrees in the first plane;

a terminal portion extending from the first body portion at the terminal end for mounting on a printed circuit board; and a contact portion extending from the second body portion at the contact end for making contact with a corresponding contact of a mating connector, such that when the electrical contact is oriented so that the first direction and the first plane are both substantially vertical, then the second direction and the second plane are both substantially horizontal, and the first direction is substantially perpendicular to the second plane.

2. The electrical contact of claim 1 wherein the transition portion includes a bend of 180 degrees in the first plane.

3. The electrical contact of claim 2, wherein the transition portion is a generally U-shaped portion.

4. The electrical contact of claim 2, wherein the transition portion includes a coined portion configured to facilitate positioning of the second body portion with respect to the first body portion.

5. The electrical contact of claim 1, wherein the first body portion is configured to facilitate broadside coupling of the electrical contact, and the second body portion is configured to facilitate edge coupling of the electrical contact.

6. The electrical contact of claim 1, wherein the terminal portion is configured to provide one of a surface-mount connection and a through-hole connection.

7. The electrical contact of claim 1, wherein the second body portion is resilient.

8. An electrical connector comprising a plurality of the electrical contacts of claim 1.

9. The electrical connector of claim 8, wherein the first body portion of each electrical contact is positioned to facilitate broadside coupling between adjacent electrical contacts, and the second body portion of each electrical contact is positioned to facilitate edge coupling between adjacent electrical contacts.

10. The electrical connector of claim 8, wherein the electrical contacts are arranged in a ground-signal-signal-ground (G-S-S-G) arrangement.

11. The electrical connector of claim 8, wherein the electrical contacts are arranged in a ground-signal-ground-signal (G-S-G-S) arrangement.

* * * * *